US005607534A

United States Patent [19]

Kawanishi et al.

[11] Patent Number: 5,607,534

[45] Date of Patent: Mar. 4, 1997

[54] METHOD OF RECYCLING SUPPORT MATERIAL FOR IMAGE-BEARING MEMBER

[75] Inventors: Toshiyuki Kawanishi; Masato Igarashi; Eiichi Kawamura, all of Numazu; Tadashi Saitoh; Kiyoshi Tanikawa, both of Yokohama; Kakuji Murakami, Kawasaki, all of Japan

[73] Assignee: Ricoh Company, Ltd., Tokyo, Japan

[21] Appl. No.: 293,323

[22] Filed: Aug. 22, 1994

[30] Foreign Application Priority Data

| | | | |
|---|---|---|---|
| Aug. 20, 1993 | [JP] | Japan | 5-228187 |
| Sep. 30, 1993 | [JP] | Japan | 5-244633 |
| Sep. 30, 1993 | [JP] | Japan | 5-244634 |
| Oct. 1, 1993 | [JP] | Japan | 5-247051 |
| Oct. 14, 1993 | [JP] | Japan | 5-256905 |
| Oct. 14, 1993 | [JP] | Japan | 5-280524 |
| Oct. 26, 1993 | [JP] | Japan | 5-267472 |
| Feb. 28, 1994 | [JP] | Japan | 6-054534 |

[51] Int. Cl.[6] ..... B41M 7/00

[52] U.S. Cl. ..... 156/234; 15/77; 156/230; 162/4; 162/56; 427/140; 427/141; 427/264; 427/270; 427/271

[58] Field of Search ..... 162/4, 56; 427/264, 427/270, 271, 140, 141; 428/195, 211, 913, 537.5, 914, 484, 488.1, 488.4; 503/201; 15/77; 156/230, 234

[56] References Cited

U.S. PATENT DOCUMENTS

| | | | |
|---|---|---|---|
| 5,102,733 | 4/1992 | Zawadski | 428/343 |
| 5,474,617 | 12/1995 | Saito et al. | 134/15 |

*Primary Examiner*—B. Hamilton Hess

*Attorney, Agent, or Firm*—Oblon, Spivak, McClelland, Maier & Neustadt, P.C.

[57] ABSTRACT

A method of recycling a support material for supporting images thereon, at least part of the support material including a paper layer which contains cellulose fibers as the main component and bears thereon hydrophobic images having a coloring agent and a heat softening or thermofusible material, includes the steps of causing the support material to hold a water-containing image peeling liquid thereon; bringing an image peeling member into contact with the hydrophobic images while the image peeling liquid is held on the support material; and peeling the hydrophobic images off the paper layer, with the image peeling liquid being held in an amount of 1.0 g or more per A4-size paper layer, or with the rate of the penetration of the image peeling liquid into the paper layer of the support material being set at 12 ml/m$^2$ or more for a contact time of 0.4 seconds in which the image peeling liquid is in contact with the paper layer, or with the contact angle of the image peeling liquid with respect to the hydrophobic images being 100° or less.

16 Claims, 8 Drawing Sheets

METHOD OF RECYCLING SUPPORT MATERIAL FOR IMAGE-BEARING MEMBER

BACKGROUND OF THE INVENTION

1. Field of the Invention

The present invention relates to a method for recycling a support material for an image-bearing member, at least part of the support material comprising a paper layer which comprises cellulose fibers and bears thereon hydrophobic images comprising a coloring agent and a heat-softening or thermofusible material, by peeling the hydrophobic images away from the paper layer.

2. Discussion of Background

Because of recent rapid development of office automation, a large quantity of papers for printers and copying machines has been used and consumed. This has caused the problems of the environmental disruption of the earth due to deforestation.

Conventionally, in order to recycle papers of this kind, printed ink is removed from the paper, and the ink-free paper is crushed and paper is made therefrom again. This has been an only method of recycling this kind of paper materials.

However, recently a method for recycling used copy papers by cleaning printed images off the surface of the copy paper has been developed, and examples of such a recycling method have been described, for instance, in the following references:

(1) Japanese Laid-Open Patent Application 4-67043

There is proposed a sheet-shaped support material for bearing images thereon. One side of this support material is surface-treated to make releasable, so that images can be formed on the support material and released therefrom repeatedly. This sheet is distinguished from a plain copy paper by putting a mark on the sheet. The above-mentioned support material, however, has the following drawbacks:

(a) This surface-treated sheet is a special paper, so that it is not easy to apply the sheet to the commonly used copying machines and printers.

(b) Therefore, it is difficult to use the above-mentioned surface-treated papers and plain copy papers and use them in the same copying machine.

(c) In view of the significance of recycling resources, duplex copies which bear images on both sides thereof are useful and will become very popular in the future. Under such circumstances, however, the method for recycling copy papers by applying a releasing agent to one side of a copy paper is neither effective nor useful.

(d) Since a releasing agent is applied to a support sheet, the image fixing performance thereof is poor as a matter of course.

(2) Japanese Laid-Open Patent Applications 1-101576 and 1-101577

A toner-image-bearing copy paper is immersed into an organic solvent in which a resin contained in the toner images formed on the copy paper is soluble, and is then subjected to an ultrasonic wave treatment, thereby removing toner images from the copy paper. This method, however, has the shortcomings that organic solvents used cause air pollution problems and are ignitable and toxic, accordingly not suitable for office or home use.

(3) Japanese Laid-Open Patent Application 1-297294

In this application, plastics, metals, papers into which liquids hardly penetrate, and ceramics are employed as the support materials for a toner-image-bearing member. Toner images formed on the support are heated through a thermofusible releasing member, whereby toner images are peeled from the support and the support is cleaned. In this method, however, a special erasable paper subjected to releasing treatment has to be used. Therefore, this method has the shortcoming that it cannot be applied to a large quantity of copy paper and printing paper now in general use.

SUMMARY OF THE INVENTION

It is therefore a first object of the present invention is to provide a method for recycling a support material of an image-bearing member by peeling PPC copied or printed images off generally used plain copy paper as well as removing copied images or printing images formed on special erasable paper.

A second object of this invention is to provide a method for recycling a support material of an image-bearing member by peeling images away from the image-bearing member easily and completely.

A third object of the present invention is to provide a support material for bearing images thereon, on which hydrophobic images can be formed and peeled away therefrom without being creased and extended in the course of image peeling operation, and which can be repeatedly used for image formation without any problems even when recycled.

The aforementioned first and second objects of the invention can be achieved by a method of recycling a support material for supporting images thereon, at least part of the support material comprising a paper layer which comprises cellulose fibers as the main component and bears thereon hydrophobic images comprising a coloring agent and a heat softening or thermofusible material, comprising the steps of: causing the support material to hold an image peeling liquid comprising water thereon; bringing an image peeling member into contact with the hydrophobic images, while the image peeling liquid is held on the support material; and peeling the hydrophobic images off the paper layer, with the image peeling liquid being held in an amount of 1.0 g or more per A4-size (i.e., a surface area of 210 mm×297 mm) of the paper layer.

The first and second objects of the present invention can also be achieved by a method of recycling a support material for supporting images thereon, at least part of the support material comprising a paper layer which comprises cellulose fibers as the main component and bears thereon hydrophobic images comprising a coloring agent and a heat softening or thermofusible material, comprising the steps of: causing the support material to hold an image peeling liquid comprising water thereon; bringing an image peeling member into contact with the hydrophobic images, while the image peeling liquid is held on the support material; and peeling the hydrophobic images off the paper layer, with the rate of the penetration of the image peeling liquid into the paper layer of the support material being 12 ml/m$^3$ or more per a contact time of 0.4 seconds in which the image peeling liquid is in contact with the paper layer.

Further, the first and second objects of the present invention can also be achieved by a method of recycling a support material for supporting images thereon, at least part of the support material comprising a paper layer which comprises cellulose fibers as the main component and bears hydrophobic images comprising a coloring agent and a heat softening or thermofusible material, comprising the steps of: causing the support material to hold an image peeling liquid comprising water thereon; bringing an image peeling member into contact with the hydrophobic images, with the image peeling liquid being held on the support material; and peeling the hydrophobic images off the paper layer, with the contact angle of the image peeling liquid with respect to the hydrophobic images being 100° or less.

The third object of the present invention can be achieved by a support material for supporting images thereon, at least part of which comprises a paper layer comprising cellulose fibers as the main component, having a wet tensile strength of 700 to 2,000 g/15 mm width in the machine direction and a wet tensile strength of 500 to 1,000 g/15 mm width in the cross direction, when measured in accordance with JIS P8135 (1976).

The third object of the present invention can also be achieved by a support material for supporting images thereon, at least part of which comprises a paper layer comprising cellulose fibers as the main component and a wet-strength increasing agent.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
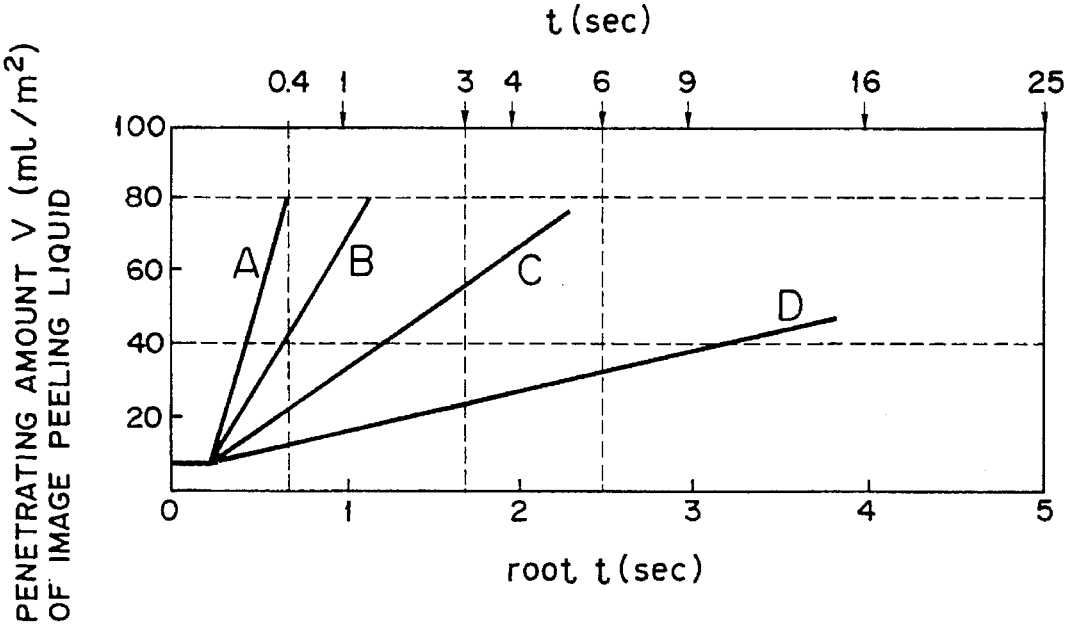
FIG. 1 is a graph which explains the penetrating properties of each of image peeling liquids employed in Examples 1, 4, 11 and 12.

The adhesion between a hydrophobic image comprising a coloring agent and a heat-softening or thermofusible material held in a paper layer of a support material, and the paper layer is extremely decreased when the paper is made wet with water.

More specifically, the surface of the cellulose-fiber-containing paper layer of the support material for the image-bearing member is provided with innumerable convex and concave portions because the cellulose fibers get intertwined with each other in the paper layer. The inside of the paper layer is also provided with uncountable minute void portions. When the hydrophobic image comprising a coloring agent and a heat-softening or thermofusible material is formed on the above-mentioned paper layer, many gaps are generated on the interface between the cellulose-fiber-containing paper layer and the hydrophobic image because a hydrophobic image fixed on the paper layer in accordance with the plain paper copying process is larger than a convex or concave portion, and a minute void portion formed by the entwined cellulose fibers of the paper layer. When such an image-bearing member is impregnated with a liquid comprising at least water (hereinafter referred to as an image peeling liquid) by coating, immersing or spraying, the image peeling liquid penetrates through the cellulose fibers and the void portions formed in the paper layer by the capillarity, and reaches the contact portion between the hydrophobic image and the cellulose fibers. As a result, the adhesion between the hydrophobic image and the cellulose fibers is decreased. In addition, the cellulose fibers are deformed by the swelling effect when absorbing the image peeling liquid. Therefore the gap at the interface between the hydrophobic image and the cellulose fibers is enlarged, so that the contact area between the cellulose fibers and the hydrophobic image is decreased, thereby extremely lowering the adhesion between the hydrophobic image and the cellulose fibers.

According to the present invention, the hydrophobic image can easily by removed from the paper layer of the support material without impairing the paper layer by bringing an image peeling member in contact with the support material under such a condition that the cellulose-fiber-containing paper layer is impregnated with the image peeling liquid, and transferring the hydrophobic image formed on the paper layer to the image peeling member.

For wetting the paper layer of the support material which bears the hydrophobic image with an image peeling liquid in a short time, the wettability of the paper layer by the image peeling liquid is of great importance. Further, it is necessary that a sufficient amount of image peeling liquid penetrate through the interface between the hydrophobic image and the paper layer of the support material in order to peel the image from the paper layer.

To promote the capillarity of the image peeling liquid through the paper layer and allow the image peeling liquid to adequately and quickly penetrate into the paper layer which bears the hydrophobic images, a surfactant, a water-soluble organic compound and/or a water-soluble polymer may be added to the image peeling liquid, or such a component may previously be contained in the paper layer of the support material for the image-bearing member.

In the present invention, by selecting the kind of surfactant, water-soluble organic compound or water-soluble polymer and adjusting the amount thereof, the image peeling liquid is held in an amount of 1.0 g or more per A4-size paper layer, or the rate of the penetration of the image peeling liquid into the paper layer of the support material is controlled to 12 ml/m$^2$ or more for a contact time of 0.4 seconds in which the image peeling liquid is in contact with the paper layer. Alternatively, the contact angle of the image peeling liquid with respect to the hydrophobic image is controlled to 100° or less.

The surface tension of the image peeling liquid is preferably 70 dyn/cm or less to satisfy the above-mentioned conditions.

Many kinds of surfactant can be employed in the image peeling liquid. Specific examples of the surfactant include anionic surfactants, cationic surfactants, ampholytic surfactants and nonionic surfactants.

Specific examples of the anionic surfactant are salts of carboxylic acid such as soap, N-acylamino acid salt, alkyl ether carboxylate, and acylated peptide; salts of sulfonic acid such as alkyl sulfonate, alkylbenzenesulfonate, alkylnaphthalenesulfonate, sulfosuccinate, α-olefinsulfonate, and N-acylsulfonate; salts of sulfate such as sulfated oil, alkylsulfate, alkyl ether sulfate, alkylaryl ether sulfate, and alkylamide sulfonate; and salts of phosphate such as alkylphosphate, alkyl ether phosphate and alkylaryl ether phosphate.

Specific examples of the cationic surfactant are quaternary ammonium salts, heterocyclic amines, and amine derivatives.

Specific examples of the nonionic surfactant are as follows:

1. Ether type nonionic surfactants:
   - Alkylpolyoxyethylene ether, and alkylallylpolyoxyethylene ether.
   - Alkylallylformaldehyde condensed polyoxyethylene ether.
   - Block polymer comprising polyoxypropylene as a lipophilic group.
   - Polyoxyethylene polyoxypropylalkyl ether.
   - Polyoxyethylene alkylphenyl ether.
2. Ether ester type nonionic surfactants:
   - Polyoxyethylene ether of glycerin ester.
   - Polyoxyethylene ether of sorbitan ester.
   - Polyoxyethylene ether of sorbitol ester.
3. Ester type nonionic surfactants:
   - Polyethylene glycol fatty acid ester.
   - Glycerin ester.
   - Polyglycerin ester.
   - Sorbitan ester.
   - Propyleneglycol ester.
   - Sucrose ester.
2. Nitrogen-containing nonionic surfactants:
   - Fatty acid alkanol amide.
   - Polyoxyethylene fatty acid amide.
   - Polyoxyethylene alkylamine.
   - Amine oxide.

Any of the above-mentioned surfactants can be used in the present invention, but nonionic surfactants are preferred because the change of the surface resistivity of the recycled paper can be prevented.

In addition, a silicone surfactant, particularly, a silicone surfactant comprising methylsiloxane as at least part of a hydrophobic group, and polyalkyleneoxide and/or carboxylic acid group as at least part of a hydrophilic group is preferable. This is because the deterioration of reproducibility of images due to a silicone oil attached to the image-bearing member at the image-fixing step can be prevented, thereby increasing the degree of whiteness of paper and enhancing the image quality of the copied and printed images obtained on the recycled paper.

Further, fluorine-containing surfactants can be used in the present invention. Examples of the fluorine-containing surfactant are as follows: fluoroalkyl ($C_2$–$C_{10}$)carboxylic acid, disodium N-perfluorooctanesulfonyl glutamate, sodium 3-[fluoroalkyl($C_6$–$C_{11}$)oxy]-1-alkyl($C_3$–$C_4$)sulfonate, N-[3-(perfluorooctanesulfonamide)propyl]-N,N-dimethyl-N-carboxymethylene ammonium betaine, fluoroalkyl($C_{11}$–$C_{20}$)carboxylic acid, perfluoroalkyl-carboxylic acid ($C_7$–$C_{13}$), lithium perfluoroalkyl($C_4$–$C_{12}$)sulfonate, potassium perfluoroalkyl($C_4$–$C_{12}$)sulfonate, sodium perfluoroalkyl($C_4$–$C_{12}$)sulfonate, N-propyl-N-(2-hydroxyethyl)perfluorooctanesulfonamide, perfluoroalkyl($C_6$–$C_{10}$)sulfonamide propyltrimethylammonium salt, perfluoroalkyl($C_6$–$C_{10}$-N-ethylsulfonylglycine salt (K), and phosphoric acid bis(N-perfluorooctylsulfonyl-N-ethylaminoethyl.

The choice of the surfactant is not particularly restriced in the present invention. The surfactant may be contained in the image peeling liquid. Alternatively, the paper layer of a support material for the image-bearing member may be prepared in such a manner that the paper layer contains the surfactant therein. In this case, water can be used as the image peeling liquid.

The concentration of the surfactant in the image peeling liquid is preferably in the range of 0.01 to 20 wt. %, more preferably in the range of 0.01 to 5 wt. %. When the concentration of the surfactant is excessively high, the paper is provided with electroconductivity. This will cause some problems when the paper is subjected to copying operation again.

Examples of the water-soluble organic compound for use in the image peeling liquid include water-soluble alcohols such as ethyl alcohol, 1-propanol, 2-propanol, 1-butanol, 2-butanol, ethylene glycol, diethylene glycol and glycerin, and mixtures thereof; and water-soluble carboxylic acids such as acetic acid and propionic acid.

The concentration of the water-soluble organic compound in the image peeling liquid is preferably in the range of 0.1 to 20 wt. %.

Examples of the water-soluble polymer for use in the image peeling liquid are shown in Table 1:

TABLE 1

- Water-Soluble Polymers
  - Natural polymers
    - Starch
      - Sugar cane starch
      - Potato starch
      - Tapioca starch
      - Wheat starch
      - Cone starch
    - Mannan
      - Konnyaku
    - Seaweeds
      - Glue plant
      - Agar
      - Sodium alginate (nontoxic)
    - Plant mucilage
      - Bibiscus
      - Tragacanth gum
      - Gum arabic
    - Microorganism mucilage
      - Dextran
      - Levan
    - Protein
      - Glue
      - Gelatin
      - Casein
      - Collagen
  - Semi-synthesized products
    - Cellulose
      - Viscose
      - Methyl cellulose (MC) (low toxic)
      - Ethyl cellulose (EC)
      - Hydroxyethyl cellulose (HEC)
      - Carboxymethyl cellulose (CMC) (nontoxic)
    - Starch
      - Soluble starch
      - Carboxymethyl starch (CMS)
      - Dialdehyde starch
  - Synthesized products
    - Polyvinyl alcohol (poval)
    - Sodium polyacrylate
    - Polyethylene oxide
    - Isobutylene - maleic anhydride copolymer The concentration of the water-soluble polymer in the image peeling liquid is preferably in the range of 0.1 to 20 wt. %, more preferably in the range of 0.5 to 10 wt. %. When the concentration of the water-soluble polymer is excessively high, the viscosity becomes high, so that the image peeling liquid cannot penetrate into the paper layer of the image-bearing member quickly.

These surfactants, water-soluble organic compounds, and water-soluble polymers are used as sizing agents for paper in paper-manufacturing industry. Therefore even if these surfactants, water-soluble organic compounds and water-soluble polymers are employed, they do not impair the surface of paper, but improve the quality of the surface of paper.

It is preferable that the image peeling liquid for use in the present invention further comprise an antiseptic and/or a mildewproofing agent (hereinafter collectively referred to as a preservative) in order to use the image peeling liquid for an extended period of time. In such a case, it is preferable that the amount of the preservative be in the range of 0.01 to 5 wt. %, more preferably in the range of 0.05 to 0.05 wt. % of the total weight of the image peeling liquid. When the preservative is added to the image peeling liquid in such an amount, the desired effect can be obtained, and the phenomenon that a component insoluble in the image peeling liquid separates out can be prevented.

The preservative for use in the image peeling liquid is not particularly restricted. For example, any preservatives printed in an extra-illustrated table attached to "Journal of Antibacterial and Antifungal" Vol. 8, No. 3 to Vol. 9, No. 6, published by The Society for Antibacterial and Antifungal Agents, Japan are available. For example, sodium 2-pyridinethiol-1-oxide, "Sodium OMADINE" (Trademark), made by Olin Corporation; para-hydroxybenzoate, "Neo Mmekkings" (Trademark), made by Ueno Fine Chemicals Industry, Ltd.; thiabendazole, "SINTOL M100" (Trademark), made by Shinto Paint Co., Ltd; 1,2-benzoisothiazoline-3-on, "PROXEL AB" (Trademark), made by ICI Japan Limited.; and hexahydro-1,3,5-tris-(2-hydroxyethyl)-S-triazine, "SAN,AI BAC P" (Trademark), and a mixture of 1,2-benzoisothiazoline-3-on and sodium 2-pyridinethiol-1-oxide, "SAN-AI BAC P-100" (Trademark), made by San-Ai Oil Co., Ltd.

Furthermore, the image peeling liquid may further comprise a chelating agent to prevent a part of a colored charge controlling agent and a dye from being dissolved in the image peeling liquid; and a fluorescent brightener or a bluing dye to increase the degree of whiteness of paper by visual appreciation after the toner image is peeled from the paper.

Examples of the chelating agent for use in the image peeling liquid are ethylenediaminetetraacetic acid, nitrilotriacetic acid, hydroxyethyl ethylene diaminetriacetic acid, and diethylenetriaminepentaacetic acid. The effects of the chelating agent can be obtained by adding the chelating agent to the image peeling liquid in an amount of 1 wt. % or less.

The fluorescent brightener comprising stilbene and diaminostilbenedisulfonic acid derivatives may be added to the image peeling liquid in an amount of about 0.01 to 1 wt. %.

Examples and of the bluing dye include Methyl Violet, Methylene Blue and Crystal Violet. In particular, Methyl Violet is preferably employed. The amount of the bluing dye is preferably in the range of about 0.0001 to 0.001 wt. % of the total weight of the image peeling liquid.

As a support material for the image-bearing member, copy paper and printing paper are mainly used. It is not always necessary that the support material consist of paper in its entirety, but any support material can be used so long as at least part of the support material comprises a paper layer comprising cellulose fibers and capable of bearing hydrophobic images comprising a coloring agent and a heat-softening or thermofusible material. For instance, a composite material composed of a cellulose-fiber-containing paper layer and a plastics layer which are overlaid can be employed.

To prevent the support material for the image-bearing member from becoming creased and extended without lowering the penetrating rate of the image peeling liquid through the paper layer of the support material in the image peeling operation, it is preferable that the support material have a wet tensile strength of 700 to 2,000 g/15 mm width in the machine direction and 500 to 1,000 g/15 mm width in the cross direction when measured in accordance with JIS P8135 (1976).

A wet-strength increasing agent may be added to the pulp as an additive to increase the tensile strength of the support material for the image-bearing member. For the wet-strength increasing agent, an agent comprising at least one component selected from the group consisting of melamine-formalin resin, polyamide-epichlorohydrin resin, or a mixture of polyamide-epichlorohydrin resin and a water-soluble anionic resin can preferably be employed.

When a mixture of polyamide-epichlorohydrin resin and a water-soluble anionic resin is employed, any conventional water-soluble anionic resins are usable, and in particular, carboxymethyl cellulose, polyvinyl alcohol and starch are preferable. In this case, it is preferable that the amount ratio by weight of the polyamideepichlorohydrin resin be in the range of 40 to 80 wt. % of the total weight.

The formalin resins, such as melamine-formalin resin and urea-formalin resin are generally employed to obtain a paper with high wet strength. The melamine-formalin resin is superior to the urea-formalin resin in that the adsorption of the resin to pulp is excellent and the yield is high because the melamine-formaline resin is available in a cationic colloidal solution. The above-mentioned resins undergo condensation and a part of resin is allowed to react with cellulose fibers by the application of heat in a drying unit of a paper machine.

The previously mentioned polyamideepichlorohydrin resin is obtained by allowing a low-molecular polyamide, that is a reaction product of a dicarboxylic acid and a diamine having a secondary amine group in its molecule, to react with epichlorohydrin. This resin is a cationic polymer, so that it can readily be adsorbed by the pulp, and it is convenient to handle in a state of an aqueous solution. An epoxy group in the molecule of the polyamideepichlorohydrin resin is allowed to react with a hydroxyl group of the pulp and chemically bonded thereto.

The support material for use in the present invention can easily be obtained by adding the above-mentioned wet-strength increasing agent to the pulp by internal addition in the course of the manufacture of paper. The wet-strength increasing agent may appropriately be added to the pulp, and in particular, it is preferable that the amount of the wet-strength increasing agent be in the range of 0.10 to 1.00 wt. % of the total weight of the pulp.

According to the method of recycling the support material for the image-bearing member of the present invention, an image peeling member is brought into contact with the image-bearing member holding the image peeling liquid thereon, and the hydrophobic images are peeled from the paper layer of the support material.

Examples of a material for use in the image peeling member include high-molecular materials such as polyethylene terephthalate, polystyrene, polypropylene, acrylic resin, methacrylic resin, epoxy resin, styrene-butyl acrylate copolymer and styrene-butadiene copolymer. In particular, a resin with substantially the same SP value as that of a resin component contained in the thermoflexible ink is preferably employed for the image peeling member.

In addition, a water-soluble polymer and/or a resin component contained in an adhesive agent can be used as the high-molecular material for the image peeling member. Specific examples of the resin component contained in the adhesive agent are protein-based resins such as glue, gelatin, albumin and casein; carbohydrate-based resins such as starch, cellulose, and complex poly-saccharide including gum arabic and gum tragacanth; thermoplastic resins such as vinyl acetate polymer and copolymer, acrylic copolymer, ethylenic copolymer, polyamide, polyester, and polyurethane; and rubbers such as polychloroprene rubber, nitrile rubber, reclaimed rubber, SBR rubber, and natural rubber.

The material for the image peeling member for use in the present invention is not particularly limited to the above-mentioned materials, and may be water-soluble or not so long as it has adhesion to the hydrophobic images.

In the present invention, an organic high-molecular material with a thermal deformation temperature of 80° C. or more is preferably employed as the material for the image peeling member. When the thermal deformation temperature is lower than 80° C., the image peeling ratio decreases. For example, when the hydrophobic images are formed on the support material and peeled therefrom 100 times, the image peeling ratio is decreased to about 50%. Further, the glass transition temperature of the organic high-molecular material for the image peeling member is preferably 40° C. or more to improve the image peeling ratio.

The thermal deformation temperature of the high-molecular material is obtained by measuring in accordance with ASTM D648-56 with the application of a load of 4.6 kg/cm$^2$. The glass transition temperature of the high-molecular material is measured in accordance with the differential thermal analysis (DTA) using a commercially available differential thermal analyzer "TG-DTA2000" (Trademark), made by Mac-Science Co., Ltd.

It is preferable that the contact angle of the surface portion of the image peeling member with water be 60° or more. In this case, the affinity of the hydrophobic image for the image peeling member becomes stronger than the affinity of the image for the paper layer of the support material. Therefore, the hydrophobic image tends to be easily attached to the image peeling member, thereby improving the peeling of images from the image-bearing member.

Furthermore, in the case where of the surface roughness of the image peeling member is 0.4 μm or less in terms of the center-line mean roughness (Ra) in accordance with JIS B 0601, the adhesion properties of the image peeling member with the hydrophobic image are increased. Accordingly, the hydrophobic image can efficiently be peeled from the paper layer of the support material.

In addition, it is preferable that the surface roughness of the image peeling member be 5 mm or less in terms of the maximum height (Rmax) in accordance with JIS B 0601. In this case, a large gap is not formed between the hydrophobic image and the image peeling member. This will make it possible to peel the toner image from the paper layer of the image-bearing member efficiently.

In addition, an expanded resin, a titanium-oxide-containing resin or an expanded resin containing titanium oxide is preferably employed for the surface portion of the image peeling member to increase the image peeling ratio.

Furthermore, it is preferable that the surface portion of the image peeling member comprise a resin with a surface resistivity of $10^{12}$ Ω or more. This will not cause a problem where the hydrophobic image is peeled from the support material of the image-bearing member with a slight trace of image remaining thereon.

The above-mentioned resins for use in the image peeling member can be formed into a sheet, a belt, a tape or a roller. Alternatively, those resins may be employed by providing on the surface of a sheet- or roller-shaped support. As such an image peeling member, for example, a rubber-based or acrylic pressure sensitive adhesive agent may be provided on the surface of the support of cellophane tape, adhesive craft-paper tape, polyvinyl chloride tape, acetate tape, or filament-reinforced tape. In this case, it is preferable that the surface of the support be porous or comprise a porous material thereon. Alternatively, the surface of the support may be surface-treated to have surface roughness.

In addition to the previously mentioned organic high-molecular materials, metallic materials with high surface activity energy, for instance, aluminum and nickel, and materials deposited with the above-mentioned metallic materials can be used for the image peeling member.

The features of this invention will become apparent in the course of the following description of exemplary embodiments, which are given for illustration of the invention and not intended to be limiting thereof.

EXAMPLES 1 to 15

Toner images were formed on a commercially available copy paper (Trademark "PPC Paper Type 6200", made by Ricoh Company, Ltd.), using a commercially available plain paper copying machine (Trademark "FT6920", made by Ricoh Company, Ltd.).

Figure 8:
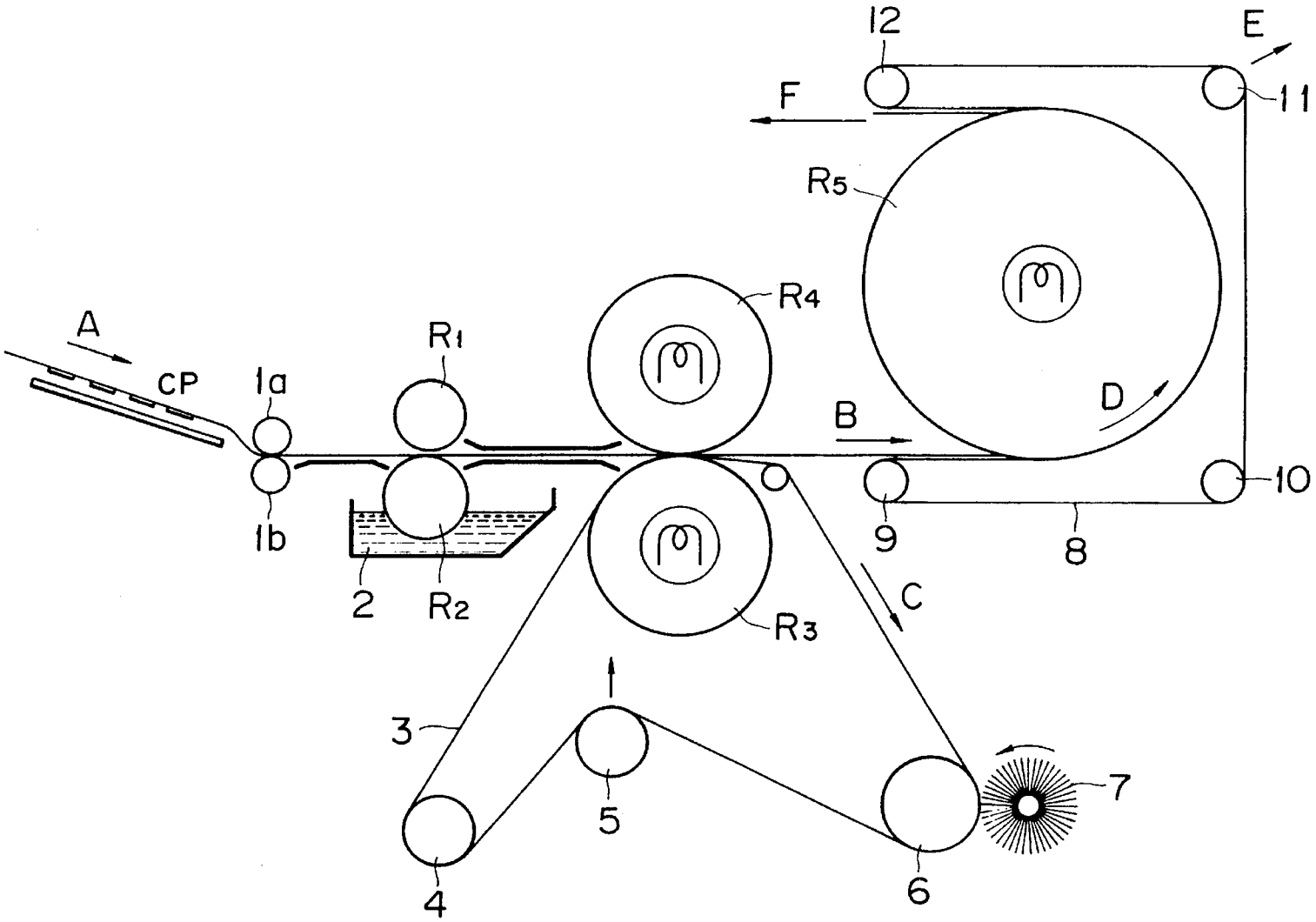
FIG. 8 is a schematic diagram which shows an apparatus used to peel the toner image off the image-bearing member.

The thus prepared toner image bearing copy paper was immersed into an image peeling liquid as shown in Table 2 and the toner image was peeled from the copy paper using an apparatus as shown in FIG. 8.

More specifically, as shown in FIG. 8, an toner image bearing copy paper CP is transported into the direction of the arrow A, with toner images faced downward, between a pair of transportation rollers 1*a* and 1*b*, and is then into between an image peeling liquid application roller $R_1$ and a counterpart holding roller $R_2$, at which an image peeling liquid 2 held in a tray in which the image peeling liquid application roller $R_1$ is half placed is applied to the toner-image bearing side of the copy paper CP. The toner image bearing copy paper CP is then transported between an image peeling member 3 in the form of an endless belt which is trained over tension application rollers 4, 5 and 6, and a heating roller $R_3$ with an inner heater and a counterpart heating roller $R_4$ with an inner heater, so that the toner images are peeled off the support material of the image bearing copy paper by the image peeling member 3, and the support material is dried by the pair of the heating rollers $R_3$ and $R_4$ and is then transported in the direction of the arrow B. The toner images removed from the image bearing copy paper CP are transported by the image peeling member 3 in the direction of the arrow C and are removed from the image peeling member 3 by a cleaning roller 7, so that the image peeling member 3 becomes ready for the next toner image peeling process.

The support material which is free from the toner images is then transported in the direction of the arrow D between a heating roller $R_5$ with an inner heater and an endless transportation belt 8 which is trained over tension application rollers 9, 10, 11 and 12 and is brought into pressure contact with the surface of the heating roller $R_5$ by the tension applied thereto in the direction of the arrow E, so that the support material is completely dried and dischared in the direction of the arrow F.

Tables 2 and 3 show the applied amount of each image peeling liquid on a sheet of the image-bearing member of A4 size, the surface tension of each image peeling liquid, the penetrating amount of each image peeling liquid through the image-bearing member during the period of contact time of 0.4 sec, the contact angle of each image peeling liquid with the toner image, the HLB of a surfactant employed in each image peeling liquid, and the toner image peeling ratio, each of which was obtained by the following methods:

(1) The surface tension of the image peeling liquid was measured in accordance with the Whilhelmy method by use of a commercially available measuring instrument, "Surface Tensiometer-A3" (Trademark), made by Kyowa Kagaku Co., Ltd., employing a platinum plate.

Figure 6:
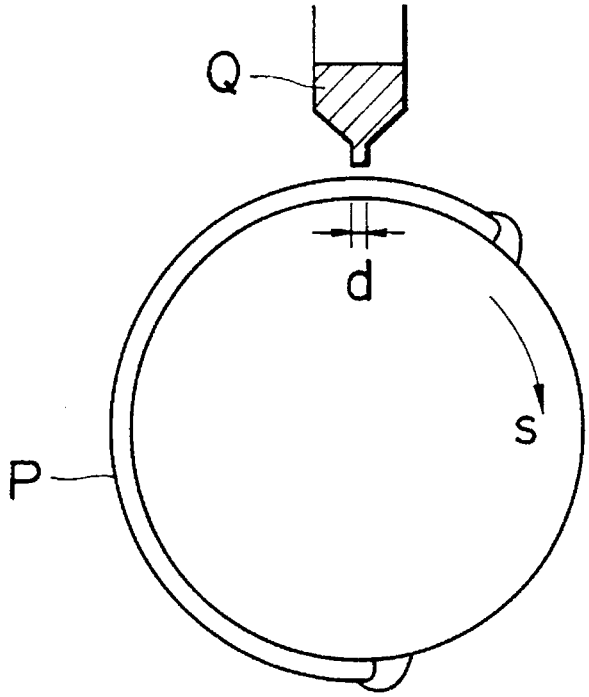
FIG. 6 is a schematic diagram of a Bristow tester used to measure the penetrating amount of an image peeling liquid into the support material of the image-bearing member.

(2) The penetrating amount of the image peeling liquid through the image-bearing member was measured by use of a commercially available measuring instrument "Bristow Tester" (Trademark), made by Toyo Seiki Seisaku-sho, Ltd., as shown in FIG. 6.

As shown in FIG. 6, a copy paper P was attached to the surface of a rotating drum with a diameter of 50 cm and a width of 2.5 cm. An image peeling liquid in an amount (Q) of 40 μl was applied to the copy paper P through a 1 mm (d)×1.75 mm (w) slit while the drum was rotated in the direction of arrow at a speed (S) of 0.5 to 50 mm/sec.

Figure 7:
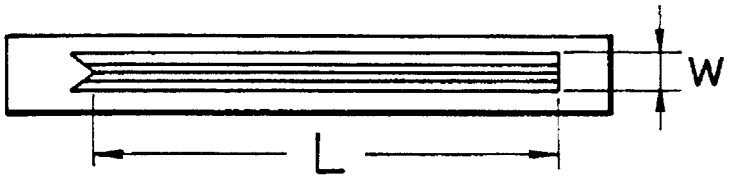
FIG. 7 is a schematic diagram which shows an image peeling liquid applied to the image-bearing member.

FIG. 7 is a schematic view which shows the copy paper bearing thereon the image peeling liquid, which has an area of (L)×(w). The contact time (t) of the image peeling liquid with the image-bearing copy paper, and the penetrating amount (V) of the image peeling liquid through the image-bearing copy paper were calculated in accordance with the following formulas:

$$\text{Contact time } (t) = d/S = 1.0/S$$

Penetrating amount of image peeling liquid through image-bearing copy paper $(V)=1000\times Q/(w\times L)$ It is supposed that the penetrating amount of the image peeling liquid through the image-bearing copy paper thus obtained was approximate to the value obtained by the following formula of Lucas-Washburn:

$$V=k(r\cdot St\cdot\cos A\cdot t/2\text{vis.})^{1/2}$$

wherein r is a radius of a capillary tube of paper; St is a surface tension of the image peeling liquid; A is an advancing contact angle of the image peeling liquid with the paper; and vis. is a viscosity of the image peeling liquid.

Figure 2:
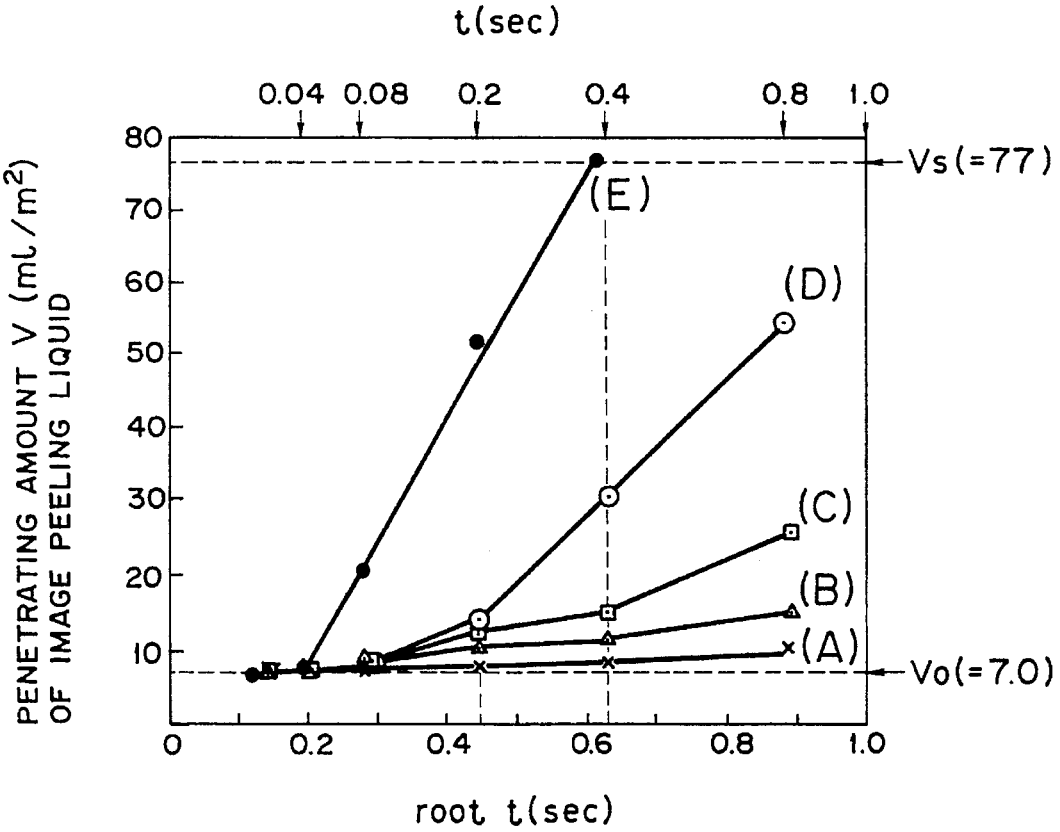
FIG. 2 is a graph which explains the penetrating properties of each of image peeling liquids employed in Examples 16, 17 and 18, and Comparative Examples 1 and 2.

Therefore, the penetrating properties of the image peeling liquid were evaluated by plotting the penetrating amount of the image peeling liquid and the square root of contact time (t), as shown in FIGS. 1 and 2.

In the case of an aqueous liquid, however, the liquid is first transferred to the rough surface of a sheet of the paper in an extremely short time when coming into contact with the paper. The amount of the liquid first transferred to the paper is referred to as $V_0$. Thereafter the liquid penetrates through the paper in accordance with the Locas-Washburn formula. Therefore, a true value of the penetrating amount of the image peeling liquid can be obtained from the Lucas-Washburn formula by subtracting the amount $V_0$ from the amount V, as follows:

$$(V-V_0)=k'(r\cdot St\cdot\cos A\cdot t/2\text{vis.})^{1/2}$$

Figure 9:
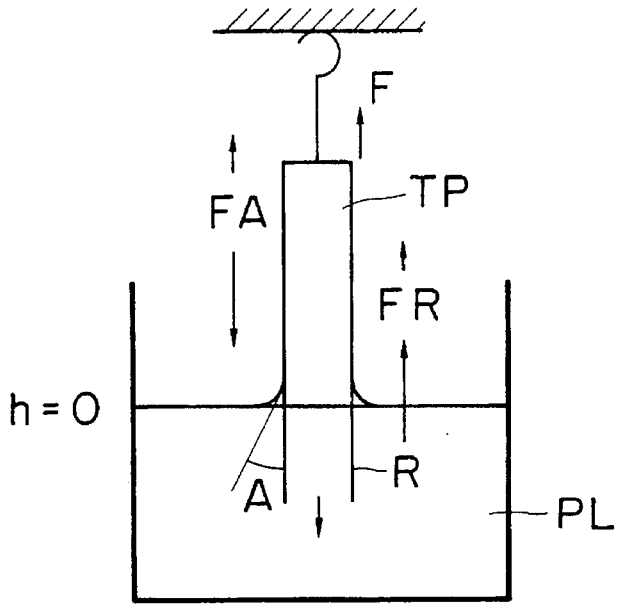
FIG. 9 is a schematic view which explains a method of measuring the dynamic contact angle of an image peeling liquid with a toner.

(3) The contact angle of an image peeling liquid with the toner was measured by use of a commercially available dynamic contact angle measuring instrument "DCA-20" (Trademark), made by Orientec Corporation, as shown in FIG. 9.

As shown in FIG. 9, a sheet of paper (TP) bearing toner images on both sides thereof was immersed in an image peeling liquid (PL) at a speed of 100 mm/min. The paper (TP) was moved from the initial position with a depth (h) of 0 mm, to the position with a depth (h) of 10 mm.

Then, the paper (TP) was pulled up from the image peeling liquid (PL).

Figure 10:
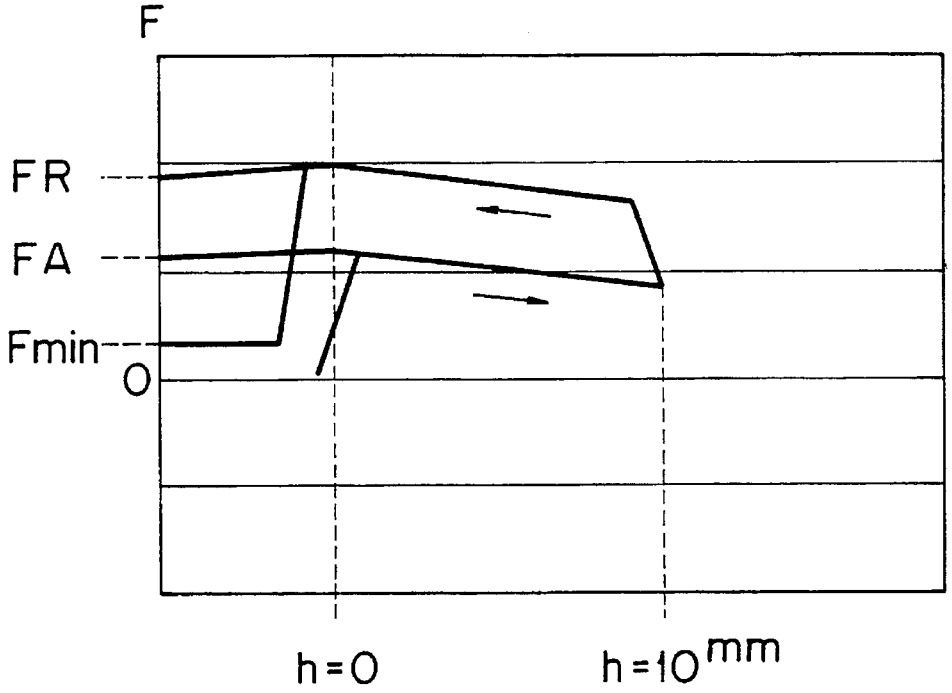
FIG. 10 is a chart which shows the change of the tension of an image peeling liquid in the measurement of the dynamic contact angle.

When the tension (F) was measured throughout the above-mentioned operation, the tension was changed as shown in a chart of FIG. 10.

In accordance with the formula (1), the advancing contact angle (A) of the image peeling liquid with the toner can be calculated from the tension (FA) which is obtained when the paper (TP) is just immersed into the image peeling liquid:

$$\cos A=FA/St\cdot L \quad (1)$$

wherein St is a surface tension of the image peeling liquid, and L is a perimeter of the paper (TP).

In accordance with the formula (2), the receding contact angle (R) of the image peeling liquid with the toner can be calculated from the tension (FR) which is obtained when the paper (TR) is just pulled up from the image peeling liquid:

$$\cos R=Fr/St\cdot L \quad (2)$$

The tension (FR) is a value which is obtained with no buoyancy being applied, so that the receding contact angle (R) is generally zero. Therefore, the formulas (3) and (4) are derived from the formula (2):

$$\cos R=1 \quad (3)$$

accordingly, $$FR/L=St \quad (4).$$

The image peeling liquid penetrates into the inside of the paper (TP), so that it is necessary to correct the tension (FR) by subtracting a tension ($F_{min}$) which is obtained after the paper (TP) is pulled up from the image peeling liquid, as follows:

$$(FR-F_{min})/L=St \quad (5)$$

The following formula (6) can be derived from the formulas (1) and (5), so that the advancing contact angle (A) can be obtained:

$$\cos A=FA/(FR=F_{min}) \quad (6)$$

In accordance with the formula (6), the advancing contact angle (A) can be obtained if the surface tension of the image peeling liquid is unknown. The value of ($FR-F_{min}$) is regarded as a dynamic surface tension measured by the above-mentioned measuring instrument.

(4) The HLB value of the surfactant and/or the water-soluble organic compound for use in the image peeling liquid was obtained in accordance with the following formula:

$$\text{HLB value}={}^{(I)}/_{(O)}\times 10$$

wherein (I) is the inorganic property which is expressed by multiplying the number of hydroxyl groups of an alcohol by 100, and (O) is the organic property which is expressed by multiplying the number of carbon atoms by 20.

For instance, to obtain the HLB value of ethyl alcohol, the number of hydroxyl groups, and the number of carbon atoms of ethyl alcohol may be substituted for (I) and (O) in the aforementioned formula, respectively. Ethyl alcohol contains one hydroxyl group and two carbon atoms, so that the HLB value of ethyl alcohol is obtained from the following formula:

$$HLB\ \text{value}=\frac{1\times 100}{2\times 20}\times 10=25$$

Figure 11:
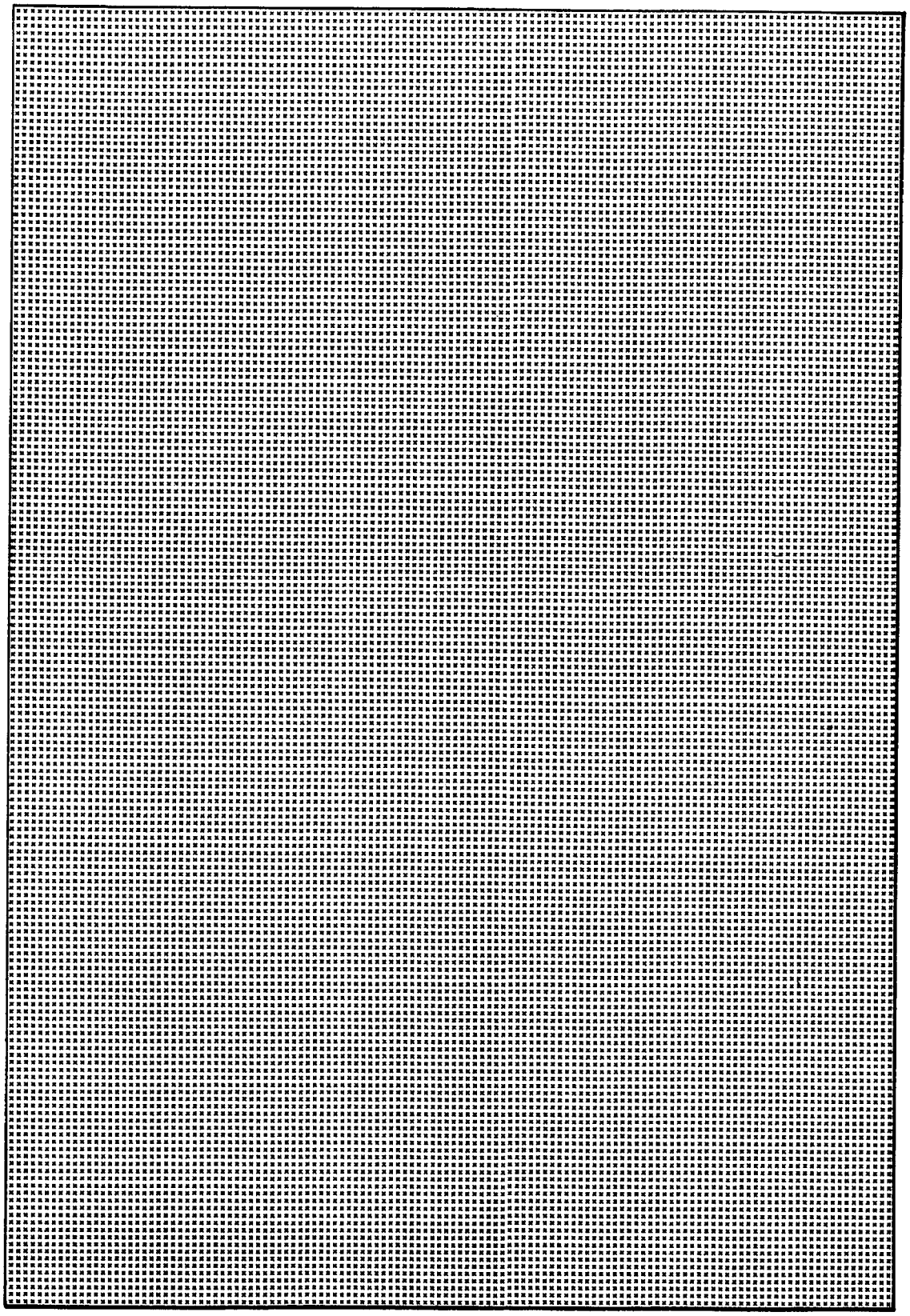
FIG. 11 is a test chart used to evaluate the toner image peeling ratio.

(5) The toner image peeling ratio was obtained using a test chart as shown in FIG. 11. More specifically, toner images were formed on a copy paper using the test chart. After the toner images of the test chart pattern were peeled from the copy paper, the number of marks "x" remaining on the copy paper was visually checked and the toner image peeling ratio was roughly calculated.

In the present invention, the toner image peeling ratio of 80% or more was allowable when the processing speed was 6 cpm. At the processing speed of 1 cpm, the toner image peeling ratio of 90% or more was allowable, and the toner image peeling ratio of 95% was preferable.

TABLE 2

| | Image Peeling Liquid | | | |
|---|---|---|---|---|
| | Formulation (wt. %) | Applied Amount on Image-bearing Member (g/A4) | Surface Tension (dyn/cm) | Penetrating Amount for 0.4 sec. (ml/m$^2$) |
| Ex. 1 | Pure water: (99.0) Surfactant, Trademark "Aerosol AY": (1.0) | 5.5 | 34 | 80 |
| Ex. 2 | Pure water: (99.7) Surfactant, Trademark "Aerosol MA": (0.3) | 2.5 | 30 | 50 |
| Ex. 3 | Pure water: (99.5) Surfactant, Trademark "Aerosol OT": (0.5) | 4.0 | 26 | 60 |
| Ex. 4 | Pure water: (99.0) Surfactant, Trademark "Sodium Dodecylsulfate": (1.0) | 3.0 | 30 | 45 |
| Ex. 5 | Pure water: (99.5) Surfactant, Trademark "Surfynol 465": (0.6) | 4.0 | 34 | 65 |
| Ex. 6 | Pure water: (98.0) Surfactant, Trademark "Surfynol 485": (2.0) | 3.5 | 36 | 50 |
| Ex. 7 | Pure water: (99.0) Surfactant, Trademark "Ionet MS-1000": (1.0) | 4.5 | 35 | 65 |
| Ex. 8 | Pure water: (98.5) Surfactant, Trademark "Ionet MO-600": (1.5) | 5.0 | 30 | 75 |
| Ex. 9 | Pure water: (98.5) Surfactant, sodium laurate (1.5) | 3.5 | 35 | 50 |
| Ex. 10 | Pure water: (99.5) Surfactant, sodium oleate (0.5) | 2.5 | 40 | 45 |
| Ex. 11 | Pure water: (99.5) Surfactant, Trademark "Aerosol IB": (0.5) | 2.0 | 45 | 20 |
| Ex. 12 | Pure water: (99.8) Surfactant, Trademark "Ionet DO-600": (0.2) | 1.5 | 40 | 12 |
| Ex. 13 | Pure water: (90) 1-propanol: (10) | 3.5 | 30 | 60 |
| Ex. 14 | Pure water: (90) 1-propanol: (5) Ethyl alcohol: (5) | 3.0 | 35 | 40 |
| Ex. 15 | Pure water: (90) Ethyl alcohol: (10) | 2.0 | 39 | 15 |

TABLE 3

| | Contact Angle of Image Peeling-off Liquid with Toner (°) | HLB of Surfactant or Water-soluble Organic Compound | Toner Image Peeling Ratio (Note 1) (%) |
|---|---|---|---|
| Ex. 1 | 80 | 18.5 | 100 |
| Ex. 2 | 75 | 15.4 | 100 |
| Ex. 3 | 45 | 11.6 | 100 |

TABLE 3-continued

| | Contact Angle of Image Peeling-off Liquid with Toner (°) | HLB of Surfactant or Water-soluble Organic Compound | Toner Image Peeling Ratio (Note 1) (%) |
|---|---|---|---|
| Ex. 4 | 85 | 20.8 | (100)<br>95 |
| Ex. 5 | 60 | 13 | 100 |
| Ex. 6 | 70 | 18 | (100)<br>95 |
| Ex. 7 | 70 | 15.7 | 100 |
| Ex. 8 | 50 | 13.7 | 100 |
| Ex. 9 | 65 | 14 | 100 |
| Ex. 10 | 80 | 18 | (100)<br>95 |
| Ex. 11 | 90 | 23.1 | (95)<br>80 |
| Ex. 12 | 100 | 10.4 | (90)<br>70 |
| Ex. 13 | 50 | 16.7 | (100)<br>95 |
| Ex. 14 | 80 | approx. 20 | (100)<br>90 |
| Ex. 15 | 95 | 25 | (90)<br>80 |

Note 1:
The numerals in the upper row is the image peeling ratio obtained at the processing speed of 6 cpm, and the numerals enclosed in parentheses in the lower row is the one obtained at the processing speed of 1 cpm.

(A) FIG. 1 is a graph in explanation of the penetration properties of the image peeling liquids through the paper layer of the copy paper, which were obtained by the Bristow's method. In FIG. 1, lines A, B, C and D show the relationship between the penetrating amount of the image peeling liquid through the copy paper and the square root of the contact time (t), that is, a period of time while the image peeling liquid is brought into contact with the toner-image-bearing paper, respectively obtained in Examples 1, 4, 11 and 12.

As is apparent from the graph shown in FIG. 1, the penetrating amount of the image peeling liquid through the image-bearing member is proportional to the square root of the contact time.

When the penetrating amount of the image peeling liquid through the image-bearing member is 20 ml/m$^2$ or more, preferably 40 ml/m$^2$ or more, the toner image can be peeled from the image-bearing member in a good condition. As directed by the line D obtained in Example 12, the penetrating amount of the image peeling liquid through the image-bearing member is 12 ml/m$^2$ during the contact time of 0.4 sec. It takes about 3 and 10 seconds to obtain the penetrating amount of the image peeling liquid of 20 ml/m$^2$, and 40 ml/m$^2$ respectively in Example 12. As directed by the line C obtained in Example 11, it takes about 0.4 and 2 seconds to obtain the penetrating amount of the image peeling liquid of 20 ml/m$^2$, and 40 ml/m$^2$ respectively.

Figure 12:
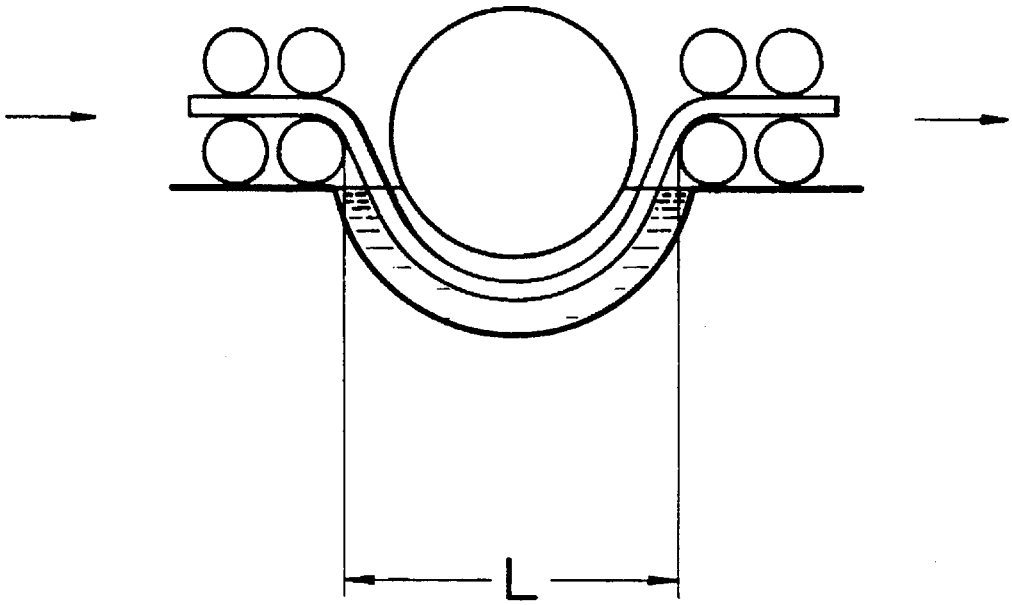
FIG. 12 is a schematic view which shows one embodiment of the image peeling method.

FIG. 12 is a schematic diagram which shows one embodiment of the image peeling method, in which an image-bearing member is brought into contact with an image peeling liquid by passing through a relatively long path (L) of the image peeling liquid. For instance, in the case where the path of the image peeling liquid has a length of 30 mm, the contact time (t) of the image-bearing member with the image peeling liquid is 6.0 seconds when the processing speed is controlled to 1 cpm, that is, a linear speed of 5 mm/sec; and the contact time (t) is 1.0 second when the processing speed is controlled to 6 cpm, that is, a linear speed of 30 mm/sec. The processing speed is preferably 1 cpm or more, more preferably 6 cpm or more for the practical use. It is necessary that the penetrating amount of the image peeling liquid be 12 ml/m$^2$ or more during the contact time of 0.4 seconds.

(B) It is also confirmed from Table 3 that the toner image can effectively be peeled from the image-bearing copy paper when the image peeling liquid comprises a surfactant and/or a water-soluble organic compound with an HLB value of 10 to 25, preferably 11 to 23.

(i) In the case of a surfactant of sodium dialkylsulfosuccinate:

The image peeling liquids comprising commercially available surfactants of sodium dialkylsulfosuccinate, "Aerozol AY", "Aerozol MA" and "Aerozol OT" (Trademark), made by American Cyanamid Co., were respectively employed in Examples 1, 2 and 3. The surfactants "Aerozol AY", "Aerozol MA" and "Aerozol OT" respectively having 10, 12 and 16 carbon atoms in dialkyl group, show the HLB value of 18.5, 15.4 and 11.6. When these surfactants were used in the image peeling liquids, the toner images were effectively peeled from the image-bearing member as shown in Table 3. On the other hand, the image peeling liquid comprising a commercially available surfactant of sodium dialkylsulfosuccinate, "Aerozol IB" (Trademark), made by American Cyanamid Co., was employed in Example 11. This kind of surfactant having 8 carbon atoms in dialkyl group shows the HLB value of 23.1. The image peeling ratio obtained in Example 11 was slightly inferior as compared with the results obtained in Examples 1, 2 and 3.

(ii) In the case of a surfactant of alkylsulfonate:

A commercially available surfactant, "Sodium Dodecylsulfate" (Trademark), made by Kanto Chemical Co., Inc., with an HLB value of 20.8 was employed in Example 4. The toner images were effectively peeled from the image-bearing copy paper.

(iii) In the case of a surfactant of dialkylpolyoxyethyleneacetylene:

Commercially available surfactants "Surfynol 465" (Trademark) with an HLB value of 13 and "Surfynol 485" (Trademark) with an HLB value of 18, made by Air Products & Chemicals Inc. were respectively employed in Examples 5 and 6. The peeling of the toner images was effectively carried out.

(iv) In the case of a surfactant of fatty acid polyethylene glycol:

A commercially available polyethylene glycol monostearate, "Ionet MS-1000" (Trademark) with an HLB value of 15.7, and a commercially available polyethylene glycol monooleate "Ionet MO-600" (Trademark) with an HLB value of 13.7, made by Sanyo Chemical Industries, Ltd. were respectively employed in Examples 7 and 8. The toner image peeling ratio was satisfactory.

On the other hand, when a commercially available polyethylene glycol dioleate, "Ionet DO-600" (Trademark) with an HLB value of 10.4, made by Sanyo Chemical Industries, Ltd. was employed in Example 12, the image peeling ratio was slightly inferior as compared with the results obtained in Examples 7 and 8.

(v) In the case of a surfactant of alkylcarboxylate:

A surfactant of sodium laurate with an HLB value of 14, and a surfactant of sodium oleate with an HLB value of 18 were employed in Examples 9 and 10, respectively. The peeling of toner image was effectively carried out in both cases.

(vi) The toner image peeling ratio was satisfactory when the image peeling liquid comprising 1-propanol and/or ethyl alcohol as a water-soluble organic compound was employed, as in Examples 13, 14 and 15.

As previously mentioned, a preferable range of the HLB value of the surfactant and/or the water-soluble organic compound for use in the image peeling liquid is 11 to 23. To obtain such a preferable HLB value, a plurality of surfactants and/or water-soluble organic compounds may be used in combination. For example, when the surfactants "Ionet MO-200" (Trademark) with an HLB value of 8.4 and "Ionet MS-1000" with an HLB value of 15.7, both of which are made by Sanyo Chemical Industries, Ltd., are mixed at a ratio of 1:2 and the thus obtained mixture is used in an image peeling liquid, the peeling effect of the toner image is similar to the case where the surfactant "Ionet MO-600" (Trademark) with an HLB value of 13.7 is employed. Further, alcohols with HLB values of more than 23, for example, ethyl alcohol with an HLB value of 25, diethylene glycol with an HLB value of 27.5, and glycerin with an HLB value of 50 can be used in the image peeling liquid so long as the HLB value is adjusted within the preferable range at the final stage by mixing with other water-soluble alcohols and surfactants with HLB values of less than 23.

In addition, it is confirmed that the toner image peeling ratio is improved when the amount of the surfactant is in the range of 0.1 to 2.0 wt. % of the total weight of the image peeling liquid.

(c) It is confirmed from the results in Tables 2 and 3 that when the contact angle of the image peeling liquid with respect to the toner is 100° or less, preferably 90° or less, the peeling of the toner image can effectively be carried out.

When the contact angle of the image peeling liquid with respect to the toner is 100° or less, the satisfactory toner image peeling ratio can be obtained at a practical processing speed, namely 1 cpm or more, preferably 6 cpm or more.

EXAMPLE 16

Toner images were formed on a commercially available copy paper (Trademark "PPC Paper Type 6200", made by Ricoh Company, Ltd.), using a commercially available plain paper copying machine (Trademark "FT6960", made by Ricoh Company, Ltd.).

The thus prepared toner image bearing copy paper was immersed into an image peeling liquid comprising pure water and a commercially available surfactant (Trademark "BT-7", made by Nikko Chemicals Co., Ltd.) with a mixing ratio by weight of 99.9:0.1.

Using an apparatus as shown in FIG. 8, a heated rubber roller was brought into pressure contact with the toner image bearing side of the copy paper. When the rubber roller was released from the image-bearing copy paper, the toner images were thoroughly transferred to the rubber roller.

The copy paper which passed over the rubber roller became a plain paper free from toner images thereon.

This copy paper was dried, and toner images were formed once again on the copy paper by use of the above-mentioned copying machine. The result was that clear toner images were formed on the copy paper exactly in the same state as first formed.

The above operation was repeated 10 times. Toner images with the same quality were formed on the copy paper throughout the above ten operations.

EXAMPLES 17 AND 18

Toner images were formed on a commercially available copy paper, and peeled therefrom in the same manner as in Example 16 except that the formulation for each image peeling liquid was changed as shown in Table 4.

When the rubber roller was released from the image-bearing copy paper, the toner images were thoroughly transferred to the rubber roller. This copy paper was dried, and toner images were formed once again on the copy paper by use of the above-mentioned copying machine. The result was that clear toner images were formed on the copy paper exactly in the same state as first formed.

The above operation was repeated 10 times. Toner images with the same quality were formed on the copy paper throughout the above ten operations.

COMPARATIVE EXAMPLES 1 AND 2

Toner images were formed on a commercially available copy paper, and peeled therefrom in the same manner as in Example 16 except that the formulation for the image peeling liquid was changed as shown in Table 4.

When the rubber roller was released from the image-bearing copy paper, the toner images were not completely transferred to the rubber roller.

Table 4 shows the penetrating amount of each image peeling liquid through the image-bearing copy paper during the period of contact time of 0.4 sec, the applied amount of each image peeling liquid on a sheet of the image-bearing copy paper of A4 size, and the toner image peeling ratio.

Figure 3:
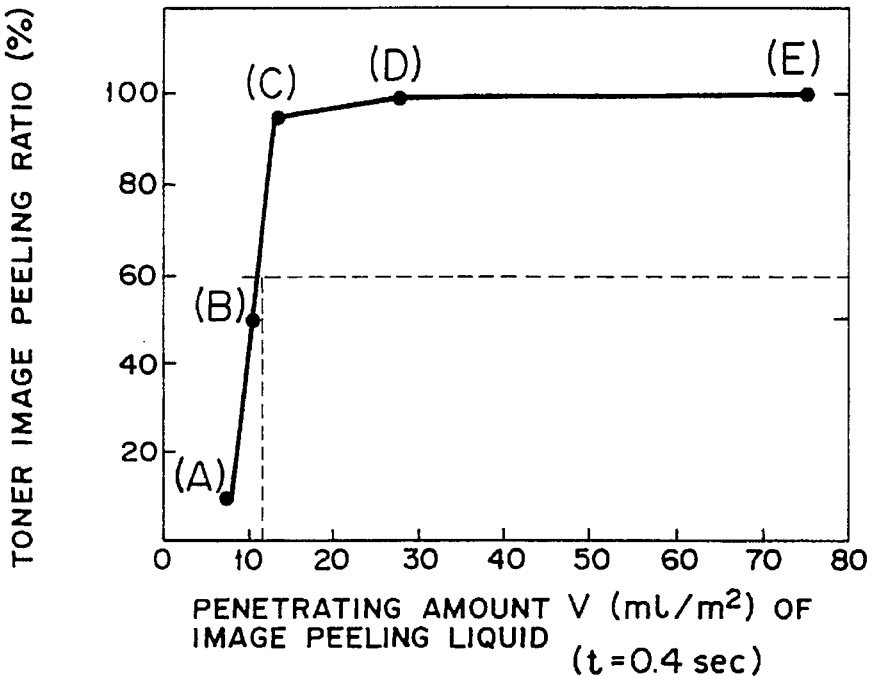
FIG. 3 is a graph which explains the relationship between the penetration amount (ml/m$^2$) of each of image peeling liquids employed in Examples 16, 17 and 18, and Comparative Examples 1 and 2, and the toner image peeling ratio.

As is apparent from the results shown in Table 4, the toner image peeling ratio is very poor in Comparative Examples 1 and 2 as compared with the results obtained in Examples 16 to 18. When consideration is given to the penetrating amount of the image peeling liquid through the image-bearing copy paper, as shown in Table 4 and FIG. 3, the peeling of the toner image can successfully be achieved by controlling the penetrating amount of the image peeling liquid through the image-bearing copy paper to 12 ml/m$^2$ or more for the contact time of 0.4 sec.

FIG. 2 is a graph in explanation of the penetration properties of the image peeling liquids through the image-bearing copy paper. In FIG. 2, lines A, B, C and D show the relationship between the penetrating volume of the image peeling liquid and the square root of the time (t), that is, a period of time when the image peeling liquid is brought into contact with the image-bearing member, respectively obtained in Comparative Example 1, Comparative Example 2, Example 16, Example 17, and Example 18.

In view of the results with respect to the liquid penetration characteristics in Comparative Examples 1 and 2, and Examples 1 to 3, which were obtained by Bristow Method, in the case where only pure water was employed as the image peeling liquid as in Comparative Example 1, there was almost no penetration of the image peeling liquid at 1.0 second (t=1.0). Furthermore, in Comparative Example 2, in which a mixture of 99.9% of pure water and 0.1% of Tonerclean 205 (B) was employed as the image peeling liquid, the value of ($V-V_0$) at 0.4 seconds (t=0.4) was about 4 ml/m$^2$. This corresponds to only about 1/20 the saturated penetration amount (about 70 ml/m$^2$) for the copy paper employed in this measurement (Trademark "Type 6200 for Ricoh PPC Paper" made by Ricoh Co., Ltd.).

In contrast to this, in the case where image peeling liquids which exhibited sufficient toner peeling ratios employed in Examples 1 to 3 were employed, the respective values of ($V-V_0$) at 0.4 seconds (t=0.4) were 7, 22 and 70 ml/m$^2$. This indicates that a sufficient toner peeling ratio can be obtained when the value of ($V-V_0$) at 0.4 seconds (t=0.4) is at least 5 ml/m$^2$.

The total amount 12 ml/m$^2$ of 5 ml/m$^2$ of this penetrated liquid and about 7 ml/m$^2$ of the liquid amount $V_0$ which physically stays on the surface of the paper corresponds to 0.75 g per A4 size paper. When the liquid is caused to absorb from both sides of the paper, the liquid is deposited on the back side as well, so that the total amount if 19 ml/m$^2$, which corresponds to about 1.2 g per A4 size paper. This indicates that when this liquid amount is 1.0 g/A4 or more, sufficient toner peeling can be performed, although the amount may differ depending upon the peeling conditions for toner, the kind of toner, and kind of paper employed.

Furthermore, it has been confirmed that for the provision of the liquid penetration amount of 0.1 g/A4 or more, which includes $V_0$, an image peeling liquid comprising an aqueous solution with a surface tension of 70 dyn/cm or less is sufficient, although an ion-exchanged water with a surface tension of 72.5 dyn/cm is not appropriate for this purpose.

When peeling conditions such as the kind of toner, the kind of paper, image peeling temperature, pressure, speed and peeling materials were taken into consideration, it was preferable to employ an image peeling liquid with a penetration amount of 2.0 g/A4 or more and with a surface tension of 60 dyn/cm or less.

Furthermore, in the case of a solid image, it is preferable that the contact angle thereof with respect to the toner by 90° or less, more preferably 80° or less.

Surfactants employed in these examples were nonionic polyoxyethylene alkyl ethers, BT-7 (HLB=12), BT-9 (HLB=13.5) and BT-12 (HLB=14.5) (made by Nikko Chemicals Co., Ltd.).

TABLE 4

| | Image Peeling Liquid | | | Toner |
|---|---|---|---|---|
| | Formulation (wt. %) | Penetrating amount for 0.4 sec. (ml/m$^2$) | Applied amount (g/A4) | Image Peeling Ratio (%) |
| Ex. 16 | Pure water: (99.9) Surtactant, Trademark "BT-7": (0.1) | 14.0 | 1.2 | 95 |
| Ex. 17 | Pure water: (99.7) Surfactant, Trademark "BT-7": (0.3) | 29.0 | 2.5 | 100 |
| Ex. 18 | Pure water: (99.0) Surfactant, Trademark "BT-12": (1.0) | 77.0 | 5.0 | 100 |
| Comp. Ex. 1 | Pure water: (100.0) | 8.0 | 0.7 | 10 |
| Comp. Ex. 2 | Pure water: (99.9) "Tonerclean 205(B)": (0.1); (Trademark) made by Nippon Nyukazai Co., Ltd. | 11.0 | 0.9 | 70 |

EXAMPLE 19

Toner images were formed on a commercially available copy paper for use with a plain paper copying machine (Trademark "PPC Paper Type 6200", made by Ricoh Company, Ltd., and a commercially available reclaimed paper (Trademark "SHIGEN", made by Ricoh Company, Ltd.), using a commercially available plain paper copying machine (Trademark "FT6960" made by Ricoh Company, Ltd.).

The thus prepared toner image bearing copy paper was immersed into an image peeling liquid comprising pure water and a commercially available surfactant (Trademark "BT-7", made by Nikko Chemicals Co., Ltd.), with a mixing ratio by weight being changed from (100:0) to 99:1).

Using an apparatus as shown in FIG. 8, a heated rubber roller was brought into pressure contact with the toner image bearing side of the copy paper. When the rubber roller was released from the image-bearing copy paper, the toner images were transferred to the rubber roller. When the deposition amount of the image peeling liquid on the image-bearing copy paper of A4 size was 1.0 g or more, the peeling of the toner image was successfully achieved.

Figure 4:
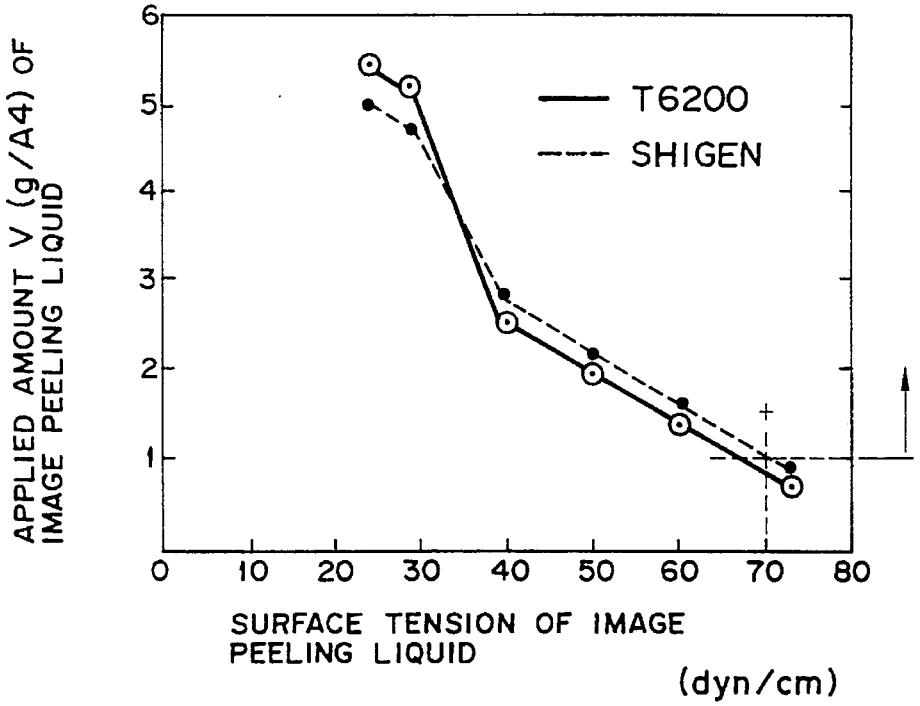
FIG. 4 is a graph which explains the relationship between the amount of an image peeling liquid held in the image-bearing member and the surface tension (dyn/cm) thereof in Example 19.

FIG. 4 is a graph which explains the relationship between the deposition amount of the image peeling liquid on the image-bearing copy paper of A4 size and the surface tension of the image peeling liquid.

As can be seen from the graph shown in FIG. 4, it is possible to hold the image peeling liquid in an amount of 1 g or more on the image-bearing copy paper of A4 size when the image peeling liquid to be employed has a surface tension of 70 dyn/cm or less.

In Example 19, the surface tension of the image peeling liquid was decreased to 70 dyn/cm or less by adjusting the amount of the surfactant "BT-7" (Trademark), made by Nikko Chemicals Co., Ltd., to 0.0001 wt. % or more of the total weight of the image peeling liquid.

EXAMPLE 20

Solid toner images were formed on a commercially available copy paper (Trademark "PPC Paper Type 6200", made by Ricoh Company, Ltd.), using a commercially available plain paper copying machine (Trademark "FT6960" made by Ricoh Company, Ltd.). The copy paper bearing the solid toner image was immersed into an image peeling liquid comprising pure water and a commercially available surfactant (Trademark "BT-12", made by Nikko Chemicals Co., Ltd.), with a mixing ratio by weight being changed from (100:0) to 99:1).

Using an apparatus as shown in FIG. 8, a heated rubber roller was brought into pressure contact with the solid toner image bearing side of the copy paper. When the rubber roller was released from the image-bearing copy paper, the toner images were transferred to the rubber roller.

Figure 5:
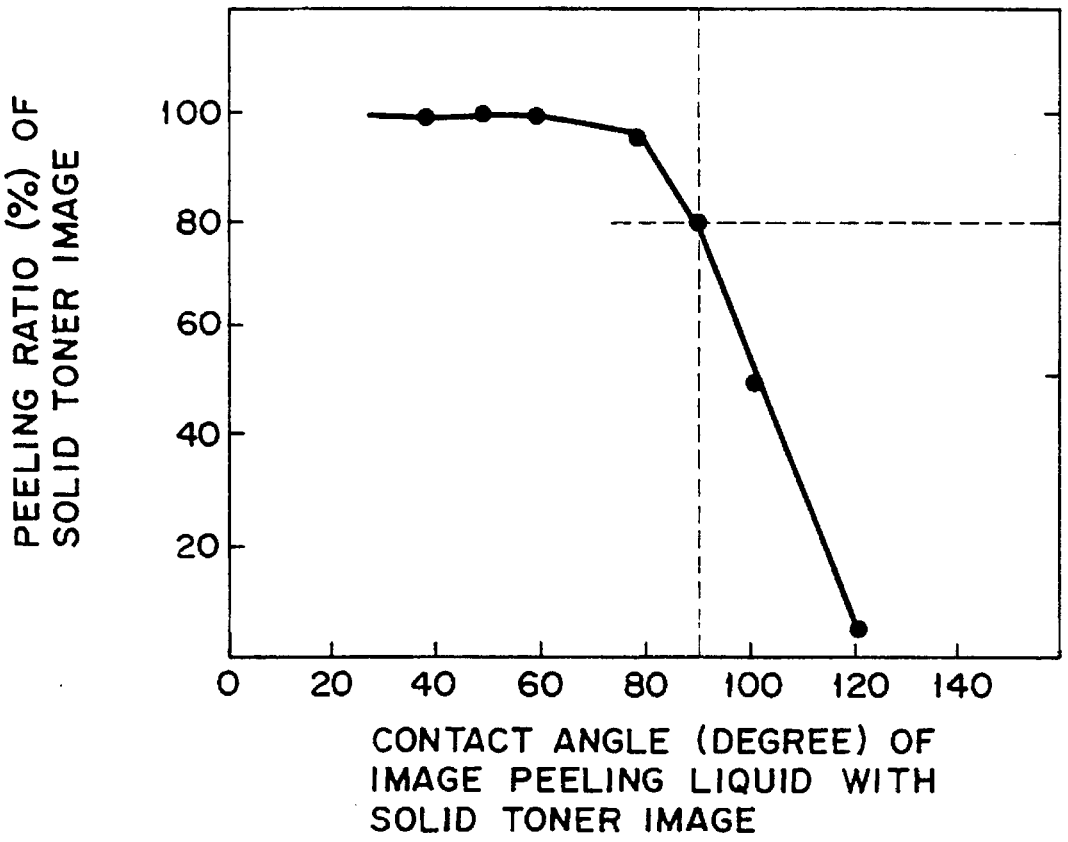
FIG. 5 is a graph which explains the relationship between the contact angle of an image peeling liquid obtained in Example 20 with a solid toner image, and the peeling ratio of the solid toner image.

FIG. 5 is a graph which explains the relationship between the contact angle of the image peeling liquid with the solid toner image and the peeling ratio of the solid toner image.

As can be seen from the graph shown in FIG. 5, the solid toner image can be peeled from the copy paper to some degree when the contact angle of the image peeling liquid with the solid toner image is controlled to 100° or less.

EXAMPLES 21 TO 23 AND COMPARATIVE EXAMPLE 2

Toner images were formed on a commercially available copy paper, and peeled therefrom in the same manner as in Example 16 except that the formulation for each image peeling liquid was changed as shown in Table 5.

The rubber roller was released from the image-bearing copy paper to transfer the toner images to the rubber roller. This copy paper was dried, and toner images were formed once again on the copy paper by use of the above-mentioned copying machine.

Table 5 shows the HLB value of the surfactant for use in each image peeling liquid, the penetrating amount of each image peeling liquid through the image-bearing copy paper during the period of contact time of 0.4 sec, and the toner image peeling ratio.

TABLE 5

| | Image Peeling Liquid | | | Toner |
|---|---|---|---|---|
| | Formulation (wt. %) | HLB of surfactant | Penetrating amount for 0.4 sec. ($ml/m^2$) | Image Peeling Ratio (%) |
| Ex. 21 | Pure water: (99.7) Surfactant, Trademark "BT-7": (0.3) | 12 | 29 | 100 |
| Ex. 22 | Pure water: (99.7) Surfactant, Trademark "BT-9": (0.3) | 13.5 | 28 | 100 |
| Ex. 23 | Pure water: (99.7) Surfactant, Trademark "BT-12": (0.3) | 14.5 | 27 | 100 |
| Comp. Ex. 2 | Pure water: (99.7) Surfactant, Trademark "BT-3": (0.3) | 8.0 | 10 | 30 |

EXAMPLES 24 TO 33

Toner images were formed on a commercially available copy paper (Trademark "PPC Paper Type 6000", made by Ricoh Company, Ltd.), using a commercially available plain paper copying machine (Trademark "FT4525", made by Ricoh Company, Ltd.).

The thus prepared toner image bearing copy paper was immersed into an image peeling liquid comprising pure water and a commercially available surfactant (Trademark "BT-7", made by Nikko Chemicals Co., Ltd.) with a mixing ratio by weight of 99.5:0.5.

Thereafter, the toner image bearing copy paper was allowed to pass through the gap between an image peeling roller and a heated roller in such a fashion that the toner image bearing surface of the copy paper was brought into pressure contact with the image peeling roller. In this case, the surface temperature of the heated roller was controlled to 90° C. and the transporting speed of the toner image bearing copy paper was 20 mm/sec.

After the toner image bearing copy paper passed through the gap between the two rollers to peel the toner image from the copy paper, the copy paper was dried. Toner images were formed once again on the copy paper by use of the above-mentioned copying machine. The above operation was repeated 100 times.

Table 6 shows organic polymeric materials employed for the surface portion of the image peeling roller, the thermal deformation temperature and the glass transition temperature of each organic polymeric material, and the toner image peeling ratios at the initial stage and after the above-mentioned operation was repeated 100 times.

The thermal deformation temperature of the organic polymeric material was measured in accordance with ASTM-D648 with the application of a pressure of 66 psi.

TABLE 6

| | Organic Polymeric Material for Image Peeling Roller | Thermal Deformation Temperature (°C.) | Glass Transition Temperature (°C.) | Toner Image Peeling Ratio (%) At the initial stage | Toner Image Peeling Ratio (%) After 100 times |
|---|---|---|---|---|---|
| Ex. 24 | Polyethylene terephthalate | 140 | 70 | 100 | 100 |
| Ex. 25 | Polycarbonate | 140 | 130 | 100 | 100 |
| Ex. 26 | Polyethylene naphthalate | 160 | 113 | 100 | 100 |
| Ex. 27 | Polybutylene terephthalate | 90 | 40 | 100 | 90–100 |
| Ex. 28 | Polyfluoroethylene propylene | 150 | −5 | 100 | 80–90 |
| Ex. 29 | Polypropylene | 100 | 0 | 100 | 80–90 |
| Ex. 30 | Polytetrafluoroethylene | 120 | −68 | 95 | 80–90 |
| Ex. 31 | Polystyrene-methyl acrylate (5:5) | 80 | 45 | 100 | 90–100 |
| Ex. 32 | Saturated polyester | 75 | 67 | 100 | 50 |
| Ex. 33 | Polyvinyl chloride | 70 | 77 | 90 | 50 |

As can be seen from the results shown in Table 6, by using the image peeling roller comprising an organic polymeric material with a thermal deformation temperature of 80° C. or more, the toner image peeling ratio can be maintained to 80% or more even when the image peeling roller is used for the image peeling operation 100 times. Further, when the organic polymeric material has a thermal deformation temperature of 80° C. or more and a glass transition temperature of 40° C. or more, the toner image peeling ratio can be maintained to 90% or more.

Even though the glass transition temperature of an organic polymeric material is 40° C. or more, the toner image peeling ratio is as low as 50% after the image peeling operation is repeated 100 times in the case where the thermal deformation temperature of the organic material is less than 80° C.

The thermal deformation temperature of an organic polymeric material is 80° C. or more, the toner image peeling ratio can be maintained to 80% or more even though the glass transition temperature of the organic material is less than 40° C.

EXAMPLE 34 TO 43

Toner images were formed on a commercially available reclaimed copy paper (Trademark "PPC Paper SHIGEN", made by Ricoh Company, Ltd.), using a commercially available plain paper copying machine (Trademark "FT4525", made by Ricoh Company, Ltd.). The contact angle of the toner image with the copy paper was 100°.

The thus prepared toner image bearing copy paper was immersed into an image peeling liquid comprising pure water and a commercially available nonionic surfactant (Trademark "BT-7", made by Nikko Chemicals Co., Ltd.) with a mixing ratio by weight of 99.0:1.0.

Thereafter, the toner image bearing copy paper was allowed to pass through the gap between an image peeling roller and a heated roller in such a fashion that the toner image bearing surface of the copy paper was brought into pressure contact with the image peeling roller. In this case, the surface temperature of the heated roller was controlled by 90° C. and the transporting speed of the toner image bearing copy paper was 20 mm/sec.

After the toner image bearing copy paper passed through the gap between the two rollers to peel the toner image from the copy paper, the copy paper was dried. Toner images were formed once again on the copy paper by use of the above-mentioned copying machine. The above operation was repeated 500 times.

Table 7 shows the kind of material employed for the surface portion of the image peeling roller, the contact angle of each material with water, the surface roughness of each material in terms of the center-line mean roughness (Ra) and the maximum height (Rmax) in accordance with JIS B 0601, and the toner image peeling ratios after the above-mentioned toner image peeling operation was repeated 100 times and 500 times.

TABLE 7

| | Material for Image Peeling Roller | Contact Angle with Water (°) | Surface Roughness Ra (μm) | Surface Roughness Rmax (μm) | Toner Image Peeling Ratio (%) After 100 times | Toner Image Peeling Ratio (%) After 500 times |
|---|---|---|---|---|---|---|
| Ex. 34 | Polyethylene terephthalate (PET) | 88 | 0.01 | 0.46 | 100 | 100 |
| Ex. 35 | $TiO_3$-containing PET | 86 | 0.18 | 2.64 | 100 | 100 |
| Ex. 36 | Expanded PET | 90 | 0.02 | 0.75 | 100 | 100 |
| Ex. 37 | $SiO_2$-containing PET | 83 | 0.40 | 4.05 | 100 | 100 |
| Ex. 38 | Styrene-butadiene rubber | 107 | 0.28 | 5.32 | 100 | 90 |
| Ex. 39 | Nitrite-butyl rubber | 95 | 0.21 | 7.55 | 100 | 90 |
| Ex. 40 | Sandblasted aluminum | 60 | 0.45 | 4.50 | 100 | 90 |
| Ex. 41 | Styrene-methyl acrylate | 120 | 0.67 | 9.17 | 100 | 80 |
| Ex. 42 | Polyvinyl alcohol-vinyl acetate | 45 | 0.15 | 4.22 | 80 | 40 |
| Ex. 43 | PET subjected to antistatic finish | 56 | 0.30 | 4.05 | 90 | 50 |

As can be seen from the results shown in Table 7, the surface roughness of the image peeling roller, and the contact angle thereof with water have a close relationship to the toner image peeling ratio.

More specifically, the larger the contact angle of the image peeling member with water, the less the affinity for water. The contact angle of the image peeling member with water is 60° or more, the toner image can easily be transferred to the image peeling member.

In addition, it is preferable that the surface roughness of the image peeling member in terms of the center-line mean roughness (Ra) be 0.4 μm or less. The maximum height (Rmax) of the image peeling member is preferably 5.0 μm or less.

To effectively peel the toner image from the image-bearing copy paper, sufficient contact between the image peeling member and the toner image is necessary. It is supposed that water existing between the image peeling member and the toner image interrupts the peeling of toner images. When the surface of the image peeling member is provided with minute concave and convex portions, water is collected in the concave portions by the contact with the image peeling liquid. In this case, the toner images cannot be peeled from the copy paper efficiently. In the case of a slight amount of water, the toner image can be peeled from the copy paper by using the image peeling member of which contact angle with water is large because such an image peeling member has a small affinity for water.

EXAMPLES 44 TO 48

Toner images were formed on a commercially available copy paper for use with a plain paper copying machine using a commercially available plain paper copying machine (Trademark "IMAGIO 320 FPI", made by Ricoh Company, Ltd.).

The thus prepared toner image bearing copy paper was immersed into an image peeling liquid comprising pure water and a commercially available nonionic surfactant (Trademark "BT-7", made by Nikko Chemicals Co., Ltd.) with a mixing ratio by weight of 99.0:1.0.

Thereafter, the toner image bearing surface of the copy paper was brought into pressure contact with an image peeling film with a thickness of 100 μm by the application of heat thereto using a heated roller of about 90° C. In the image peeling operation, the toner image bearing copy paper was transported at processing speed of about 6 cpm and 3 cpm.

Table 8 shows the kind of material for the image peeling film, and the toner image peeling ratios at the processing speed of 6 cpm and 3 cpm.

TABLE 8

| | Material for Image Peeling Film | Toner Image Peeling Ratio (%) (Note 1) |
|---|---|---|
| Ex. 44 | Titanium oxide containing PET "X-20" (Trademark), made by Toray Industries, Inc. | 90 (100) |
| Ex. 45 | Titanium oxide containing PET "E-20" (Trademark), made by Toray Industries, Inc. | 95 (100) |
| Ex. 46 | Expanded PET "H-1212" (Trademark), made by Toyobo Co., Ltd. | 95 (100) |
| Ex. 47 | Expanded PET containing titanium oxide "G-1212" (Trademark), made by Toyobo Co., Ltd. | 100 (100) |
| Ex. 48 | PET | 80 (90) |

Note 1:
The numerals in the upper row is the image peeling ratio obtained at the processing speed of 6 cpm, and the numerals enclosed in parentheses in the lower row is the one obtained at the processing speed of 3 cpm.

EXAMPLE 49

Toner images were formed on a copy paper using a commercially available plain paper copying machine (Trademark "IMAGIO 320 FPI" made by Ricoh Company, Ltd.).

The thus prepared toner image bearing copy paper was immersed into an image peeling liquid comprising pure water in an amount of 99.0 wt. %, a commercially available nonionic surfactant (Trademark "BT-7"), made by Nikko Chemicals Co., Ltd. in an amount of 0.5 wt. %, and a commercially available sodium 2-pyridinethiol-1-oxide serving as a preservative, "Sodium OMADINE" (Trademark), made by Olin Corporation in an amount of 0.5 wt. %.

Then, a heated rubber roller was brought into pressure contact with the toner image bearing side of the copy paper. When the rubber roller was released from the image-bearing copy paper, the toner images were thoroughly transferred to the rubber roller. The copy paper which passed over the rubber roller became a plain paper free from toner images thereon.

The above-mentioned image peeling liquid was allowed to stand for one month. After one month, toner images were formed on the copy paper and peeled therefrom using the image peeling liquid in the same manner as mentioned above. The result was that the toner images were completely peeled from the copy paper.

EXAMPLE 50

Toner images were formed and peeled therefrom by the same method as in Example 49 except that an image peeling liquid comprising pure water in an amount of 99.5 wt. %, and a commercially available nonionic surfactant (Trademark "BT-7", made by Nikko Chemicals Co., Ltd.) in an amount of 0.5 wt. % was employed.

When the rubber roller was released from the image-bearing copy paper, the toner images were thoroughly transferred to the rubber roller. The copy paper which passed over the rubber roller became a plain paper free from toner images thereon.

The above-mentioned image peeling liquid was allowed to stand for one month. After one month, toner images were formed on the copy paper and peeled therefrom using the image peeling liquid in the same manner as mentioned above. The result was that part of toner images remained on the image-bearing copy paper, and the toner images were not completely peeled from the copy paper. In addition, a suspended matter which was insoluble in water was observed in the image peeling liquid, and such a suspended matter was deposited on the heated rubber roller after the contact between the image peeling liquid and the heated rubber roller.

EXAMPLE 51

An image peeling liquid comprising pure water in an amount of 97.5 wt. %, a water-soluble starch in an amount of 2.45 wt. % and a commercially available parahydroxybenzoic acid ester serving as a preservative "Neo Mmekkings" (Trademark), made by Ueno Fine Chemicals, Industry, Ltd. in an amount of 0.05 wt. % was stored in a sealed vessel for 3 months.

After three months, toner images were formed on the copy paper and peeled therefrom using the above-mentioned image peeling liquid in the same manner as in Example 49.

The result was that the toner images were completely peeled from the copy paper.

EXAMPLE 52

Toner images were formed and peeled therefrom by the same method as in Example 49 except that an image peeling liquid comprising pure water in an amount of 99.5 wt. %, and a commercially available sodium 2-pyridinethiol-1-oxide serving as a preservative, "Sodium OMADINE" (Trademark), made by Olin Corporation in an amount of 0.5 wt. % was employed.

When the rubber roller was released from the image-bearing copy paper, the toner images were thoroughly transferred to the rubber roller. The copy paper which passed over the rubber roller became a plain paper free from toner images thereon.

The above-mentioned image peeling liquid was allowed to stand for one month. After one month, toner images were formed on the copy paper and peeled therefrom using the image peeling liquid as mentioned above. The result was that the toner images were completely peeled from the copy paper.

EXAMPLE 53

A mixture of a commercially available polyamideepichlorohydrin resin "Epinox P-1301-A" (Trademark), made by Hercules Inc., and carboxymethyl cellulose was added to pulp in an amount of 0.15 wt. % by the internal addition in the manufacture of paper. The wet tensile strength of the above obtained paper was 1,300 g in the machine direction and 755 g in the cross direction in accordance with JIS P8175 (1976).

Toner images were formed on the above-mentioned paper using a commercially available plain paper copying machine (Trademark "IMAGIO 320 FPI", made by Ricoh Company, Ltd.).

The thus prepared toner image bearing copy paper was immersed into an image peeling liquid comprising pure water in an amount of 99.5 wt. % and a commercially available nonionic surfactant (Trademark "BT-7"), made by Nikko Chemicals Co., Ltd. in an amount of 0.5 wt. %. The penetrating amount of the image peeling liquid through the toner image bearing copy paper was 17 ml/m$^2$ during the contact time of 0.4 sec when measured in accordance with the Bristow's method.

Then, a heated rubber roller was brought into pressure contact with the toner image bearing side of the copy paper. When the rubber roller was released from the image-bearing copy paper, the toner images were thoroughly transferred to the rubber roller. The extensibility of the copy paper in the crosswise direction was 0.3% or less and no wrinkle was observed after passing over the rubber roller.

This copy paper was dried, and toner images were formed once again on the copy paper by use of the above-mentioned copying machine. The result was that clear toner images were formed on the copy paper exactly in the same state as first formed.

The above operation was repeated 5 times. Toner images with the same quality were formed on the copy paper throughout the above five operations.

EXAMPLE 54

A mixture of a commercially available polyamideepichlorohydrin resin "Kymene 557" (Trademark), made by Hercules Inc., and a commercially available polyvinyl alcohol "PVA-117" (Trademark), made by Kuraray Co., Ltd. was added to pulp in an amount of 0.20 wt. % by the internal addition in the manufacture of paper. The wet tensile strength of the above obtained paper was 1,020 g in the machine direction and 660 g in the cross direction in accordance with JIS P8135 (1976).

Toner images were formed on the above-mentioned paper using a commercially available plain paper copying machine (Trademark "RICOPY FT 6960L" made by Ricoh Company, Ltd.).

The thus prepared toner image bearing copy paper was immersed into the same image peeling liquid as used in Example 53. The penetrating amount of the image peeling liquid through the toner image bearing copy paper was 21 ml/m$^2$ during the contact time of 0.4 sec when measured in accordance with the Bristow's method.

Then, the toner images were peeled from the copy paper in the same manner as in Example 53. The copy paper which passed over the rubber roller became a plain paper.

This copy paper was dried, and toner images were formed once again on the copy paper by use of the above-mentioned copying machine. The result was that clear toner images were formed on the copy paper exactly in the same state as first formed.

The above operation was repeated 5 times. Toner images with the same quality were formed on the copy paper throughout the above five operations. Throughout the operations, the copy paper did not become creased or extended, and cellulose fibers contained in the paper layer were not peeled from the paper layer.

EXAMPLE 55

A mixture of a commercially available polyamideepichlorohydrin resin "Epinox P30" (Trademark), made by Hercules Inc., serving as a wet-strength increasing agent, and a starch was added to pulp in an amount of 0.20 wt. % by the internal addition in the manufacture of paper. The wet tensile strength of the above obtained paper was 966 g in the machine direction and 625 g in the cross direction in accordance with JIS P8175 (1976).

Toner images were formed on the above-mentioned paper using a commercially available plain paper copying machine (Trademark "IMAGIO 320 FPI", made by Ricoh Company, Ltd.).

The thus prepared toner image bearing copy paper was immersed into the same image peeling liquid as used in Example 53. The penetrating amount of the image peeling liquid through the toner image bearing copy paper was 25 ml/m$^2$ during the contact time of 0.4 sec when measured in accordance with the Bristow's method.

Then, the toner images were peeled from the copy paper in the same manner as in Example 53. The copy paper which passed over the rubber roller became a plain paper.

This copy paper was dried, and toner images were formed once again on the copy paper by use of the above-mentioned copying machine. The result was that clear toner images were formed on the copy paper exactly in the same state as first formed.

The above operation was repeated 5 times. Toner images with the same quality were formed on the copy paper throughout the above five operations. Throughout the operations, the copy paper did not become creased or extended, and cellulose fibers contained in the paper layer were not peeled from the paper.

EXAMPLE 56

A melamine-formalin resin was added to pulp in an amount of 0.30 wt. % by the internal addition in the manufacture of paper. The wet tensile strength of the above obtained paper was 1,224 g in the machine direction and 752 g in the cross direction in accordance with JIS P8175 (1976).

Toner images were formed on the above-mentioned paper using a commercially available plain paper copying machine (Trademark "IMAGIO 320 FPI", made by Ricoh Company, Ltd.).

The thus prepared toner image bearing copy paper was immersed into an image peeling liquid comprising pure water in an amount of 99.5 wt. % and a commercially available nonionic surfactant (Trademark "BT-7", made by Nikko Chemicals Co., Ltd.) in an amount of 0.5 wt. %. The penetrating amount of the image peeling liquid through the toner image bearing copy paper was 18 ml/m$^2$ during the contact time of 0.4 sec when measured in accordance with the Bristow's method.

Then, a heated rubber roller was brought into pressure contact with the toner image bearing side of the copy paper. When the rubber roller was released from the image-bearing copy paper, the toner images were thoroughly transferred to the rubber roller. The extensibility of the copy paper in the cross direction was 0.3% or less and no wrinkle was observed after passing over the rubber roller.

This copy paper was dried, and toner images were formed once again on the copy paper by use of the above-mentioned copying machine. The result was that clear toner images were formed on the copy paper exactly in the same state as first formed.

The above operation was repeated 5 times. Toner images with the same quality were formed on the copy paper throughout the above five operations.

EXAMPLE 57

A commercially available polyamideepichlorohydrin resin "Kymene 557" (Trademark), made by Hercules Inc., serving as a set-strength increasing agent was added to pulp in an amount of 0.15 wt. % by the internal addition in the manufacture of paper. The wet tensile strength of the above obtained paper was 966 g in the machine direction and 648 g in the cross direction in accordance with JIS P8175 (1976).

Toner images were formed on the above-mentioned paper using a commercially available plain paper copying machine (Trademark "IMAGIO 320 FPI", made by Ricoh Company, Ltd.).

The thus prepared toner image bearing copy paper was immersed into the same image peeling liquid as used in Example 56. The penetrating amount of the image peeling liquid through the toner image bearing copy paper was 26 ml/m$^2$ during the contact time of 0.4 sec.

Then, the toner images were peeled from the copy paper in the same manner as in Example 56. The copy paper which passed over the rubber roller became a plain paper.

This copy paper was dried, and toner images were formed once again on the copy paper by use of the above-mentioned copying machine. The result was that clear toner images were formed on the copy paper exactly in the same state as first formed.

The above operation was repeated 5 times. Toner images with the same quality were formed on the copy paper throughout the above five operations. Throughout the operations, the copy paper did not become creased or extended, and cellulose fibers contained in the paper layer were not peeled from the paper layer.

As previously mentioned, the method of recycling an image-bearing member according to the present invention is characterized by the following points:

1. The amount of the image peeling liquid held in the paper layer of the support material is controlled to 1.0 g or more per A4. Therefore, the thermoflexible ink such as a toner can sufficiently be peeled from the image-bearing member.

2. The penetrating amount of the image peeling liquid through paper layer of the image-bearing member is 12 ml/m$^2$ or more in the period of a contact time (t) of 0.4 sec. Therefore, the toner images can effectively be peeled from the image-bearing member.

3. The contact angle of the image peeling liquid with respect to the hydrophobic image is 100° or less. Therefore, the image peeling liquid can pass to the surface of the hydrophobic image, and sufficiently penetrate through the interface between the hydrophobic image and the paper layer of the image-bearing member. The adhesion between the hydrophobic image and the paper layer can be reduced to efficiently peel the toner image from the paper.

4. When the thermal deformation temperature of a material for use in the image peeling member is 80° C. or more, high toner image peeling ratio can be maintained even though the peeling of toner images is repeated.

5. When the glass transition temperature of a material for use in the image peeling member is 40° C. or more, the toner image peeling ratio obtained after the repeated peeling operation is further improved.

6. When the contact angle of a material for use in the surface portion of the image peeling member with water is 60° or more, the affinity of the image peeling member for water can be decreased. Accordingly, the toner image can readily be attached to the surface of the image peeling member even though water exists between the hydrophobic image and the image peeling member.

7. When the surface portion of the image peeling member is made even and controlled to have a surface roughness in terms of the center-line mean roughness (Ra) of 0.40 μm or less, the image peeling member is brought into contact with the hydrophobic images in a good condition. Therefore, the hydrophobic images can effectively be peeled from the image-bearing member.

8. When the surface roughness of the surface portion of the image peeling member is 5.0 μm or less in terms of the maximum height (Rmax), a water-holding gap is not generated on the surface of the image peeling member when the image peeling member is brought into contact with the toner images. Therefore, the toner images can effectively be peeled from the image-bearing member.

9. When the surface portion of the image peeling member comprises titanium oxide, an expanded resin, or titanium-oxide-containing expanded resin, the hydrophobic images formed on the support material can thoroughly be peeled therefrom without any slight trace.

10. When the surface tension of the image peeling liquid is controlled to 70 dyn/cm or less, the image peeling liquid can be held in the paper layer of the image-bearing member in an amount of 1.0 g or more per A4.

11. When the HLB of a water-soluble organic compound and/or a surfactant contained in the image peeling liquid is in the range of 10 to 25, not only the water-soluble organic compound and/or the surfactant can sufficiently be incorporated in the image peeling liquid, but also the obtained image peeling liquid can smoothly penetrate through the image-bearing member. Therefore, the toner image can effectively be peeled from the image-bearing member when the image peeling liquid is brought into contact with the hydrophobic image at a practical processing speed of 2 to 10 cpm.

12. When the image peeling liquid further comprises a preservative, the image peeling liquid can be used for a long period of time.

13. When the support material for the image-bearing member has a wet tensile strength of 700 to 2,000 g in the machine direction and of 500 to 1,000 g in the cross direction in accordance with JIS P8135 (1976), or the support material comprises a wet-strength increasing agent, it is possible to prevent the support material from becoming creased and extended in the image peeling operation.

Japanese Patent Application No. 5-228187 filed on Aug. 20, 1993; Japanese Patent Application No. 5-267472 filed on Oct. 26, 1993; Japanese Patent Application No. 6-054534 filed on Feb. 28, 1994; Japanese Patent Application No. 5-256905 filed on Oct. 14, 1993; Japanese Patent Application No. 5-244633 filed on Sep. 30, 1993; Japanese Patent Application No. 5-247051 filed on Oct. 1, 1993; Japanese Patent Application No. 5-244634 filed on Sep. 30, 1993; and Japanese Patent Application No. 5-280524 filed on Oct. 14, 1993 are hereby incorporated by reference.

What is claimed is:

1. A method of recycling a support material for supporting images thereon, at least part of said support material comprising a paper layer which comprises cellulose fibers and bears thereon hydrophobic images comprising a coloring agent and a heat softening or thermofusible material, said method comprising the steps of:

causing said support material to hold an image peeling liquid comprising water thereon;

bringing an image peeling member into contact with said hydrophobic images while said image peeling liquid is held on said support material; and peeling said hydrophobic images off said paper layer;

wherein said image peeling liquid is held in an amount of 1.0 g or more per 210 mm×297 mm surface area of said paper layer, the rate of penetration of said image peeling liquid into said paper layer of said support material is 12 ml/m$^2$ or more per a contact time of 0.4 seconds in which said image peeling liquid is in contact with said paper layer, the contact angle of said image peeling liquid with respect to the surface of said hydrophobic image is 100° or less, and wherein said image peeling liquid has a surface tension of 70 dyn/cm or less.

2. The method of recycling said support material as claimed in claim 1, wherein said image peeling liquid further comprises at least one component selected from the group consisting of a surfactant, a water-soluble organic compound, a water-soluble polymer, and an antiseptic and mildewproofing agent.

3. The method of recycling said support material as claimed in claim 2, wherein said surfactant and/or said water-soluble organic compound for use in said image peeling liquid has an HLB value of 10 to 25.

4. The method of recycling said support material as claimed in claim 1, wherein said support material has a wet tensile strength of 700 to 2,000 g/15 mm width in the machine direction and of 500 to 1,000 g/15 mm width in the cross direction when measured in accordance with JIS P8135 (1976).

5. The method of recycling said support material as claimed in claim 1, wherein said paper layer of said support material comprises a wet-strength increasing agent.

6. The method of recycling said support material as claimed in claim 5, wherein said wet-strength increasing agent comprises at least one component selected from the group consisting of melamine-formalin resin, polyamide-epichlorohydrin resin, and a mixture of polyamide-epichlorohydrin resin, and a water-soluble anionic resin.

7. The method of recycling said support material as claimed in claim 6, wherein said water-soluble anionic resin is selected from the group consisting of carboxymethyl cellulose, polyvinyl alcohol and starch.

8. The method of recycling said support material as claimed in claim 1, wherein said image peeling member comprises an organic polymeric material with a thermal deformation temperature of 80° C. or more.

9. The method of recycling said support material as claimed in claim 1, wherein said image peeling member comprises an organic material with a thermal deformation temperature of 80° C. or more and a glass transition temperature of 40° C. or more.

10. The method of recycling said support material as claimed in claim 1, wherein said image peeling member comprises a surface portion with a contact angle of 60° or more with respect to water.

11. The method of recycling said support material as claimed in claim 1, wherein said image peeling member comprises a surface portion with a surface roughness of 0.4 μm or less in terms of the center-line mean roughness (Ra) in accordance with JIS B 0601.

12. The method of recycling said support material as claimed in claim 1, wherein said image peeling member comprises a surface portion with a surface roughness of 5.0 μm or less in terms of the maximum height (Rmax) in accordance with JIS B 0601.

13. The method of recycling said support material as claimed in claim 1, wherein said image peeling member comprises a resin comprising titanium oxide.

14. The method of recycling said support material as claimed in claim 1, wherein said image peeling member comprises an expanded resin.

15. The method of recycling said support material as claimed in claim 1, wherein said image peeling member comprises an expanded resin comprising titanium oxide.

16. The method of recycling said support material as claimed in claim 1, wherein said image peeling member comprises a resin material with a surface resistivity of $10^{12}$ Ω or more.

* * * * *

UNITED STATES PATENT AND TRADEMARK OFFICE

CERTIFICATE OF CORRECTION

PATENT NO. : 5,607,534
DATED : MARCH 4, 1997
INVENTOR(S) : TOSHIYUKI KAWANISHI ET AL

It is certified that error appears in the above-identified patent and that said Letters Patent is hereby corrected as shown below:

Column 2, line 12, "invention is to" should read --invention to--.

Column 5, line 48, "2." should read --4.--.

Column 8, line 48, "0.05 to 0.05 wt." should read --0.05 to 0.5 wt.--.

Column 9, line 2, "SAN-AI" should read --SAN, AI--.

Column 12, line 1, "an" should read --a--;
line 4, "into" should read --in--;
line 17, delete "the" (second occurrence).

Column 20, line 61, "Ltd.," should read --Ltd.),--.

Column 21, line 2, "99:1)." should read --(99:1).--.
line 37, "99:1)." should read --(99:1).--.

UNITED STATES PATENT AND TRADEMARK OFFICE

CERTIFICATE OF CORRECTION

PATENT NO. : 5,607,534

DATED : MARCH 4, 1997

INVENTOR(S) : TOSHIYUKI KAWANISHI, ET AL

It is certified that error appears in the above-indentified patent and that said Letters Patent is hereby corrected as shown below:

Column 29, line 42, "set-strength" should read -- wet-strength --.

Signed and Sealed this

Twenty-first Day of July, 1998

Bruce Lehman

*Attest:*

BRUCE LEHMAN

*Attesting Officer*

*Commissioner of Patents and Trademarks*